US009080313B2

(12) United States Patent
Goodwin et al.

(10) Patent No.: US 9,080,313 B2
(45) Date of Patent: Jul. 14, 2015

(54) EXCAVATION TOOTH ASSEMBLY

(75) Inventors: Steven Goodwin, Regents Park (AU); Dylan Toth, Wavell Heights (AU)

(73) Assignee: Bradken Resources PTY Limited, Mayfield West (AU)

( * ) Notice: Subject to any disclaimer, the term of this patent is extended or adjusted under 35 U.S.C. 154(b) by 101 days.

(21) Appl. No.: 13/574,235

(22) PCT Filed: Jan. 20, 2011

(86) PCT No.: PCT/AU2011/000059

§ 371 (c)(1),
(2), (4) Date: Aug. 24, 2012

(87) PCT Pub. No.: WO2011/088511

PCT Pub. Date: Jul. 28, 2011

(65) Prior Publication Data

US 2012/0311896 A1 Dec. 13, 2012

(30) Foreign Application Priority Data

| | | |
|---|---|---|
| Jan. 20, 2010 | (AU) | 2010900213 |
| Oct. 25, 2010 | (AU) | 2010904749 |
| Nov. 17, 2010 | (AU) | 2010905098 |

(51) Int. Cl.
*E02F 9/28* (2006.01)

(52) U.S. Cl.
CPC ..... *E02F 9/2825* (2013.01); *E02F 9/2841* (2013.01)

(58) Field of Classification Search
CPC ..... E02F 9/2841; E02F 9/2883; E02F 9/2825; E02F 9/2833; E02F 9/2875; Y10T 403/7066; Y10T 403/585; Y10T 403/589; Y10T 403/7056; Y10T 403/7069; Y10T 29/4973
USPC ..... 37/446, 452–460; 172/713, 719, 172/701.1–401.3, 772, 772.5; 403/291, 403/355, 374.1, 379.2, 379.4, 379.5
See application file for complete search history.

(56) References Cited

U.S. PATENT DOCUMENTS

| | | | | |
|---|---|---|---|---|
| 4,192,089 | A * | 3/1980 | Schwappach | 37/457 |
| 4,404,760 | A | 9/1983 | Hahn et al. | |
| 4,414,764 | A | 11/1983 | Johansson et al. | |
| 4,663,867 | A * | 5/1987 | Hahn et al. | 37/459 |
| 4,823,487 | A | 4/1989 | Robinson | |
| 4,965,945 | A | 10/1990 | Emrich | |

(Continued)

FOREIGN PATENT DOCUMENTS

| | | |
|---|---|---|
| AU | 2009101186 | 12/2009 |
| WO | WO-94/18401 | 8/1994 |
| WO | WO-03/004782 | 1/2003 |

OTHER PUBLICATIONS

Goodwin, S., U.S. Office Action mailed Jun. 6, 2014, directed to U.S. Appl. No. 13/574,226; 9 pages.

(Continued)

*Primary Examiner* — Robert Pezzuto
(74) *Attorney, Agent, or Firm* — Morrison & Foerster LLP

(57) ABSTRACT

A lock for an excavation tooth assembly, the lock comprising: a body; first and second engaging portions mounted to the body and movable between respective first and second positions; wherein the engaging portions being interdependent so that movement of at least one of the first and second engaging portions causes a corresponding movement of the other of the first and second engaging portions.

21 Claims, 24 Drawing Sheets

(56) References Cited

U.S. PATENT DOCUMENTS

| | | | | | |
|---|---|---|---|---|---|
| 5,152,088 | A | | 10/1992 | Hahn | |
| 5,233,770 | A | | 8/1993 | Robinson | |
| 5,272,824 | A | | 12/1993 | Cornelius | |
| 5,423,138 | A | | 6/1995 | Livesay et al. | |
| 5,469,648 | A | * | 11/1995 | Jones et al. | 37/457 |
| 5,561,925 | A | * | 10/1996 | Livesay | 37/455 |
| 6,018,896 | A | | 2/2000 | Adamic | |
| 6,030,143 | A | * | 2/2000 | Kreitzberg | 403/374.1 |
| 6,385,871 | B1 | * | 5/2002 | Quarfordt | 37/457 |
| 6,865,828 | B1 | * | 3/2005 | Molino et al. | 37/454 |
| 7,086,185 | B2 | * | 8/2006 | Pasqualini et al. | 37/468 |
| RE40,336 | E | * | 5/2008 | Fernandez Munoz et al. | 37/456 |
| 7,367,144 | B2 | * | 5/2008 | Jones et al. | 37/456 |
| 2007/0084094 | A1 | | 4/2007 | Bentley | |
| 2008/0092413 | A1 | | 4/2008 | McClanahan et al. | |

OTHER PUBLICATIONS

International Search Report and Written Opinion mailed Apr. 27, 2011, directed to International Application No. PCT/AU2011/000053; 11 pages.

International Search Report and Written Opinion mailed Apr. 27, 2011, directed to International Application No. PCT/AU2011/000054; 11 pages.

International Search Report and Written Opinion mailed Apr. 27, 2011, directed to International Application No. PCT/AU2011/000059; 17 pages.

Goodwin, S., U.S. Office Action mailed Nov. 13, 2014, directed to U.S. Appl. No. 13/574,226; 8 pages.

Goodwin et al., U.S. Office Action mailed Nov. 17, 2014, directed to U.S. Appl. No. 13/574,217; 5 pages.

Goodwin et al., U.S. Office Action mailed Apr. 7, 2015, directed to U.S. Appl. No. 13/574,217; 8 pages.

* cited by examiner

13

EXCAVATION TOOTH ASSEMBLY

CROSS-REFERENCE TO RELATED APPLICATIONS

This application is a national stage application under 35 USC 371 of International Application No. PCT/AU2011/000059, filed Jan. 20, 2011, which claims the priority of Australian Patent Application nos. 2010900213, filed Jan. 20, 2010, 2010904749, filed Oct. 25, 2010, and 2010905098, filed Nov. 17, 2010, the contents of which prior applications are incorporated herein by reference.

FIELD OF THE INVENTION

The disclosure relates to excavation tooth assemblies, lock assemblies for use in such tooth assemblies and to components of such excavation tooth and lock assemblies. The disclosure has application in land based digging equipment and is herein described in that context. However, it is to be appreciated that the disclosure has broader application for example in waterborne excavation equipment such as dredgers, and is therefore not limited to that application.

BACKGROUND OF THE INVENTION

Excavation teeth are provided on the digging edge of various pieces of digging equipment such as the buckets of front end loaders. Each excavation tooth is formed of a number of parts, commonly a point, an adapter and a lock. The adapter is typically fitted to the excavation equipment and the point fits over the adapter and is retained in place by the lock. In some instances one or more intermediate parts may be also included between the point and the adapter. For ease of description it is to be understood that, unless the context requires otherwise, the term "adapter" used in this specification includes both the adapter arranged to be fitted to the excavation equipment or, if one or more intermediate parts are provided, to that intermediate part(s) or to the combination of the adapter and the intermediate part(s).

The reason that the excavation tooth is formed of a number of parts is to avoid having to discard the entire tooth when only parts of the tooth, in particular the ground engaging part of the tooth (i.e. the point) is worn or broken.

Various types of locks, points and adapters are known. However, it is always desirable to design new excavation tooth assemblies and parts thereof.

SUMMARY OF THE INVENTION

According to an embodiment, the disclosure provides a lock for an excavation tooth assembly, the lock comprising:

a body;

first and second engaging portions mounted to the body and movable between respective first and second positions; wherein the engaging portions being interdependent so that movement of at least one of the first and second engaging portions causes a corresponding movement of the other of the first and second engaging portions.

The corresponding movement of the other engaging portion may occur during the entire movement of the at least one engaging portion between its first and second positions.

The corresponding movement of the other engaging portion may occur during only a portion of the movement of the at least one engaging portion between its first and second positions.

The lock body may have a longitudinal axis and the engaging portions may be angularly spaced apart about the axis.

The engaging portions may be angularly spaced apart by approximately 90°.

At least one of the engaging portions may comprise a projection.

At least one of the engaging portions may comprise a recess.

The first engaging portion may be in an extended position in its first position and may be in a retracted position relative to the lock body in its second position.

The second engaging portion may be in an extended position in its first position and may be in a retracted position relative to the lock body in its second position.

The first or second engaging portions when in its retracted position may extend beyond an outer surface of the lock body.

Movement of at least one of the first and second engaging portions from the first position towards the second position may cause a corresponding movement of the other of the first and second engaging portions from the first position towards the second position The first and second engaging portions may be interconnected so that the position of the first engaging portion relative to the second engaging portion is substantially fixed on movement of the engaging portions relative to the lock body.

The first and second engaging portions may be interconnected by a web.

The web may bend approximately 90° between the first and second engaging portions.

The first and second engaging portions may be resiliently biased towards their respective first positions.

The lock may comprise one or more elastomeric members which resiliently bias the first and second engaging portions.

The lock may comprise a single elastomeric member which resiliently biases both the first and second engaging portions.

The lock body may comprises at least one cavity and the elastomeric member(s) may be held in the at least one cavity.

At least one of the engaging portions may rotate on movement from its first position to its second position.

At least one of the engaging portions may move in two directions on movement from its first position to its second position.

At least one of the engaging portions may retract and move laterally with respect to the lock body on movement from its first position to its second position.

According to another embodiment, the disclosure provides a lock for an excavation tooth assembly, the lock comprising:

a body;

first and second engaging portions mounted to the body and movable between respective extended and retracted positions; wherein at least one of the first and second engaging portions when in its retracted position extends beyond an outer surface of the lock body.

Both the first and second engaging portions when in their retracted positions may extend beyond an outer surface of the lock body.

The first engaging portion may extend beyond a first outer surface of the lock body and the second engaging portion may extend beyond a second outer surface of the lock body.

The outer surface(s) of the lock body may be a surface(s) which extends in the longitudinal direction of the lock body.

The lock body may have a cavity having at least one opening through the outer surface(s) of the lock body, the first and/or second engaging portions retracting into the cavity as they move towards their retracted positions, but with at least a part of the first and/or second engaging portions projecting through the cavity opening(s) when in their second position.

The engaging portions may be interdependent so that movement of at least one of the first and second engaging portions causes a corresponding movement of the other of the first and second engaging portions.

According to another embodiment, the disclosure provides a lock for an excavation tooth assembly, the lock comprising:

a body;

at least one engaging portion mounted to the body and movable between a first and a second position, wherein the at least one engaging portion is caused to rotate in moving from the first to the second position.

The lock body may have a longitudinal axis and rotation of the at least one engaging portion from its first to second positions may be about the longitudinal axis of the lock body.

The lock body may be curved in its longitudinal direction.

The engaging portion may be in an extended position in its first position and may be in a retracted position relative to the lock body in its second position.

The engaging portion when in its retracted position may extend beyond an outer surface of the lock body.

The lock may comprise first and second engaging portions mounted to the body, each movable between their respective first and second positions and wherein at least one of the engaging portions is caused to rotate in moving from its first to its second position.

Both first and second engaging portions may be caused to rotate in moving from their first to their second positions respectively.

The engaging portions may be interdependent so that movement of at least one of the first and second engaging portions causes a corresponding movement of the other of the first and second engaging portions.

In a variation the engaging portions may be moved independently of one another.

According to another embodiment, the disclosure provides a lock for an excavation tooth assembly, the lock comprising:

a body; and at least one engaging portion mounted to the body and movable between a first and a second position, wherein the at least one engaging portion is caused to retract and move laterally with respect to the outer surface of the lock body on movement from its first position to its second position.

The movement of the at least one engaging portion from its first position to its second position may comprise a rotation of the engaging portion.

The lock body may have a longitudinal axis and lateral movement of the at least one engaging portion from its first to second positions may be in a direction transverse to the longitudinal axis of the lock body.

The outer surface of the lock body may be a surface which extends in the longitudinal direction of the lock body.

The engaging portion may be in an extended position in its first position and may be in a retracted position relative to the lock body in its second position.

The engaging portion when in its retracted position may extend beyond the outer surface of the lock body.

The lock may comprise first and second engaging portions mounted to the body, each movable between their respective first and second positions and wherein at least one (preferably both) of the engaging portions may be caused to move in two directions with respect to an outer surface of the lock body in moving from its first to its second position.

The engaging portions may be interdependent so that movement of at least one of the first and second engaging portions causes a corresponding movement of the other of the first and second engaging portions.

According to another embodiment, the disclosure provides an excavation tooth assembly comprising:

a first tooth member having a first end, an opposite second end incorporating a socket for receiving a nose portion of a second tooth member, and at least one surface which at least in part defines a locking space when the first tooth member is in an assembled condition with the second tooth member; and a lock as disclosed above, the lock configured to be inserted into the locking space to lock the first tooth member in its assembled condition with the second tooth member.

In one form, according to the above aspects described above, the first tooth member may be a point comprising a body incorporating a first digging end and an opposite second end that incorporates the socket. In this embodiment the second tooth member is an adapter.

In another embodiment, the first and second tooth members each form part of an adapter arranged to receive a point.

According to another embodiment, the disclosure provides an excavation tooth assembly configured to be assembled into an excavation tooth which extends along a longitudinal axis, the assembly comprising:

first and second tooth members, the second tooth member having a nose portion and the first tooth member having a first end and an opposite second end incorporating a socket for receiving the nose portion of the second tooth member, wherein the first and second tooth members when in an assembled condition have surfaces which define a locking space, the locking space incorporating a groove formed in one of the surfaces defining the space, the groove extending transverse to the longitudinal axis of the assembled excavation tooth; and a lock configured to be inserted into the locking space to lock the first tooth member in its assembled condition with the second tooth member, the lock comprising a body and at least one engaging portion mounted to the lock body, the at least one engaging portion configured to travel along the groove as the lock is inserted into and removed from the locking space.

The surface in which the groove is formed may be a surface of the first tooth member.

The groove may extend transverse to a longitudinal axis of the first tooth member.

The surface in which the groove is formed may be a surface of the second tooth member.

The groove extends transverse to a longitudinal axis of the second tooth member.

The excavation tooth assembly may also comprise an engaging portion formed on the surface of the locking space which is configured to couple with the engaging portion of the lock to lock the lock in the locking space.

The groove may comprise first and second groove portions.

The groove portions may be separated by the engaging portion formed on the surface of the locking space.

The first groove portion may extend from a first end of the locking space towards the centre of the locking space and the second groove portion may extend from an opposite second end of the locking space towards the centre of the locking space.

The engaging portion formed on the surface of the locking space may be a projection or a recess.

The groove may be curved in its longitudinal direction, transverse to the longitudinal axis of the assembled excavation tooth.

According to another embodiment, the disclosure provides an excavation tooth member of an excavation tooth assembly, the tooth member comprising:

a body having a first end and an opposite second end incorporating a socket for receiving the nose portion of a further tooth member, the body extending along a longitudinal axis between its first and second ends;

at least one surface which, when the tooth member is in an assembled condition with the further tooth member, defines at least in part a locking space; and a groove formed in one of the surfaces which defines the locking space, the groove extending transverse to the longitudinal axis of the body.

The excavation tooth member may also comprise an engaging portion formed on one of the surfaces defining the locking space and which is configured to couple with the engaging portion of a lock.

The engaging portion may be a projection or a recess.

Where the engaging portion is a recess, the recess may extend in the direction of the longitudinal axis of the body and may extend transversely with respect to the longitudinal extent of the groove.

The recess may be of greater depth than the groove.

The socket may open in a rear surface at the second end of the tooth member and at least one ear may extend away from the rear surface, and wherein the at least one surface which defines the locking surface includes the rear surface and a surface of the at least one ear.

The groove may be formed in the at least one ear.

The groove may extend from the top of the ear to the bottom of the ear.

The groove may comprise a first groove portion located in an upper portion of the ear and a second groove portion located in a lower region of the ear.

The recess may extend from an edge of the ear towards the digging end of the body.

The recess may extend into the socket.

According to another embodiment, the disclosure provides an excavation tooth member of an excavation tooth assembly, the tooth member comprising:

a body having a first end and an opposite second end incorporating a socket for receiving the nose portion of a further tooth member, the body extending along a longitudinal axis between its first and second ends, at least one ear which extends away from the body at its second end; and at least one longitudinally extending recess formed in the ear for inter-engaging with a lock to lock the tooth member to the further tooth member when the nose portion is received in the socket.

The recess may extend from an edge of the ear towards the first end of the body.

The recess may extend into the socket.

According to another embodiment, the disclosure provides an excavation tooth assembly comprising:

an excavation tooth member as disclosed above; and a lock for locking the tooth member to a further tooth member when the tooth members are in an assembled condition, which is preferably a lock as disclosed above.

According to another embodiment, the disclosure provides a method of assembling an excavation tooth assembly, the method comprising:

providing a tooth member as disclosed above;

locating the tooth member on a further tooth member to bring the tooth members into an assembled condition; and locking the tooth members in their assembled condition.

According to another embodiment, the disclosure provides a method of installing a first tooth member onto a second tooth member to form an excavation tooth, the method comprising:

locating the first tooth member on the second tooth member in an assembled condition whereby a locking space is defined between surfaces of the first and/or the second tooth members;

providing a lock comprising a body and first and second engaging portions mounted to the body and movable between respective first and second positions; and inserting the lock into the locking space to lock the tooth members in their assembled condition, including moving at least one of the engaging portions from its first position towards its second position, wherein movement of at least one of the first and second engaging portions causes a corresponding movement of the other of the first and second engaging portions.

According to another embodiment, the disclosure provides a method of installing a first tooth member onto a second tooth member to form an excavation tooth, the method comprising:

locating the first tooth member on the second tooth member in an assembled condition whereby a locking space is defined between surfaces of the first and/or the second tooth members providing a lock comprising a body and first and second engaging portions mounted to the body and movable between respective extended and retracted positions; and inserting the lock into the locking space to lock the first and second tooth members in their assembled condition including moving at least one of the engaging portions into its retracted position, wherein when the at least one engaging portion is in its retracted position it extends beyond an outer surface of the lock body.

According to another embodiment, the disclosure provides a method of installing a first tooth member onto a second tooth member to form an excavation tooth, the method comprising:

locating the first tooth member on the second tooth member in an assembled condition whereby a locking space is defined between surfaces of the first and/or second tooth members;

providing a lock comprising a body and at least one engaging portion mounted to the body and movable between respective first and second positions; and inserting the lock into the locking space to lock the first and second tooth members in their assembled condition including rotating the engaging portion from its first position to its second position.

According to another embodiment, the disclosure provides a method of installing a first tooth member onto a second tooth member to form an excavation tooth, the method comprising:

locating the first tooth member on the second tooth member in an assembled condition whereby a locking space is defined between surfaces of the first and/or second tooth members providing a lock comprising a body and at least one engaging portion mounted to the body and movable between respective first and second positions; and inserting the lock into the locking space to lock the point and the adapter in their assembled condition including retracting and moving laterally the engaging portion with respect to an outer surface of the lock body from its first position to its second position.

According to another embodiment, the disclosure provides a method of installing a first tooth member onto a second tooth member to form an excavation tooth, the method comprising:

locating the first tooth member on the second tooth member in an assembled condition whereby a locking space is defined between surfaces of the first and/or second tooth members;

providing a lock comprising a body and at least one engaging portion mounted to the body and movable between respective first and second positions; and inserting the lock into the locking space to lock the first and second tooth members in their assembled condition including moving the engaging portion along a groove formed on one of the surfaces defining the locking space.

According to another embodiment, the disclosure provides a method of retrofitting an excavation tooth assembly which comprises an excavation tooth member, the method comprising removing the tooth member from the excavation tooth assembly and subsequently replacing with an excavation tooth member as disclosed above.

According to another embodiment, the disclosure provides a excavation tooth assembly which has been retrofitted with the excavation tooth member as disclosed above.

BRIEF DESCRIPTION OF THE DRAWINGS

Embodiments will now be described, by way of example only, with reference to the accompanying drawings, in which.

DETAILED DESCRIPTION OF THE INVENTION

Figure 1:
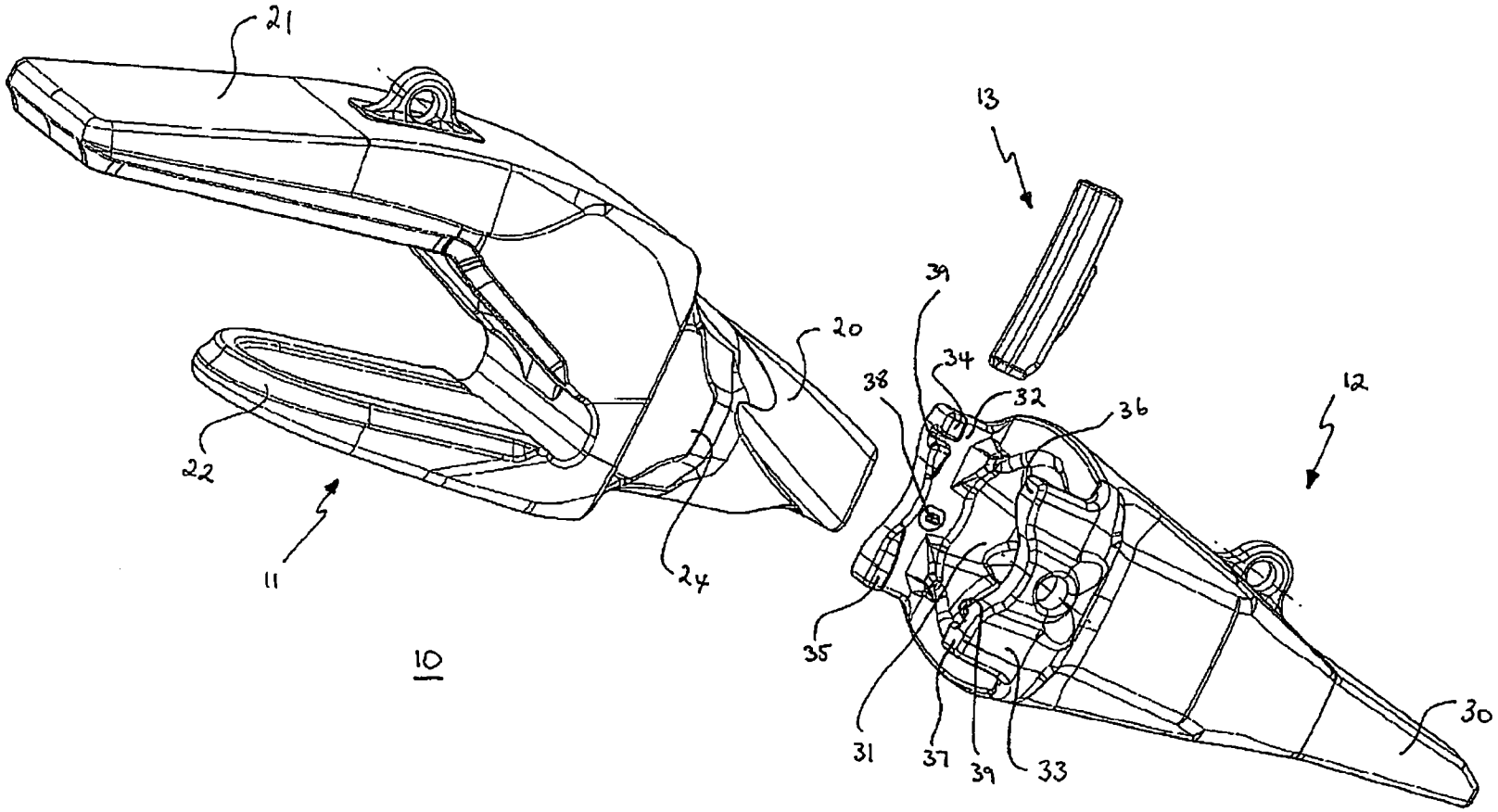
FIG. 1 is an exploded perspective view of an excavation tooth assembly according to an comprising an excavation tooth point, an excavation tooth adapter and a lock.
Figure 2:
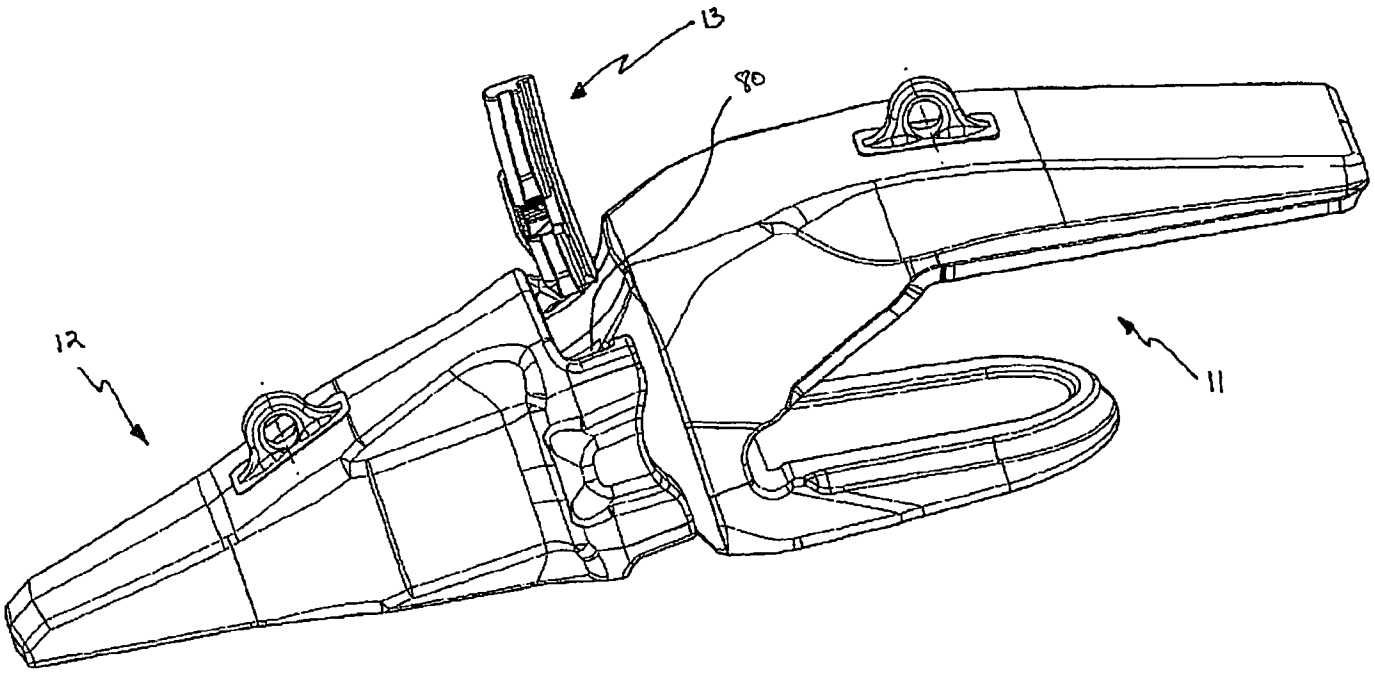
FIG. 2 is a perspective view of the excavation tooth assembly of FIG. 1 showing the lock being inserted in a space between the point and the adapter to lock the point to the adapter.

Referring to FIGS. 1-5, there is shown an excavation tooth assembly 10 according to an embodiment which can be assembled to form an excavation tooth. The assembly 10 comprises an excavation tooth adapter 11 for mounting the excavation tooth to the digging edge of digging equipment, an excavation tooth point 12 for coupling to the adapter 11 and a lock 13 for locking the point 12 to the adapter 11 to form the excavation tooth.

It is to be understood, that the embodiments described below could be applied to excavation tooth assemblies having different types of adapters as well as to assemblies having intermediate parts disposed between the point and the "adapter". It is also to be understood that the embodiments described below could be applied to excavation teeth for land based equipment such as digging buckets as well as to water related equipment such as dredges.

The adapter 11 comprises a forward projecting nose 20 and rearward arms 21, 22. The rearward arms 21, 22 are positioned either side of the digging edge of digging equipment in order to mount the adapter 11 thereto. In the illustrated form, the forward projecting nose 20 has a 'twisted' shape to reduce the torsion stresses on the adapter in use. However, it is to be appreciated that the nose 20 may be configured in shapes other than the "twisted" shape as will be appreciated by those skilled in the art. Ledges 24 are also provided on either side of the adapter between the nose 20 and the rearward arms. The purpose of these ledges will become apparent further on in the specification.

The point 12 comprises a digging edge 30 at a first end which engages the ground in use and a socket 31 at an opposite second end for receiving the nose 20 of the adapter 11.

The socket 31 has an internal 'twisted' shape, which conforms with the shape of the adapter nose 20. The point 12 is thus coupled to the adapter 11 by positioning the socket 31 at the end of the nose 20 and then twisting and pushing the point 12 until the nose 20 is received in the socket. Ears 32, 33 on either side of the point 12 extend rearwardly of the socket 31. Each ear 32, 33 has upper and lower lugs 34-37 extending inwardly at the distal end of their respective ears 32, 33. When the point 12 is coupled to the adapter 11 with the adapter nose 11 fully received in the point socket 31, the lugs 34-37 are located behind the adapter ledges 24 relative to the socket 31. In this arrangement, the ears 32, 33, the lugs 34-37 and the ledges 24 create locking spaces 80 on either side of the excavation tooth into which the lock 13 can be inserted to lock the point to the adapter in an operative position.

The point 12 also comprises a detent 38 for being received in a recess of the lock 13 to lock the point to the adapter. The detent 38 and the recess form a lock assembly and when coupled act to releaseably retain the lock within the locking space. The detent 38 has a general trapezoidal prism shape and is a projection which is elongate in the longitudinal direction of the point 12. However, the detent may be of any other suitable shape such as cylindrical or rectangular prism for example. The detent 38 is located on and protrudes inwardly from a depression 95 in the inner surface of one of the ears 32 at an intermediate portion of the ear 32 located vertically between the lugs 34, 35. A further detent (not shown) is provided on the other ear 33. This further detent is identical to the detent 38 shown and is located at an identical position on the other ear 33 to the location of the detent 38 on the ear 32. This enables the point 12 to be coupled and locked to the adapter 11 in an upside down orientation to that shown in the FIGS. 1-5. This is particularly useful in extending the life of the point 12 if the digging edge 30, in use, is wearing more on the top or bottom. A lug 34,37 on each wall may be provided with an lug recess 39 for co-operating with a different type of lock to the lock 13 described below.

Figure 3:
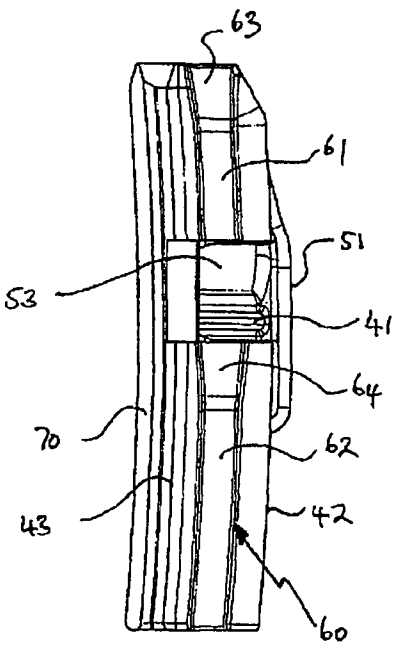
FIG. 3 is a perspective and side view of the lock of FIG. 1.
Figure 3:
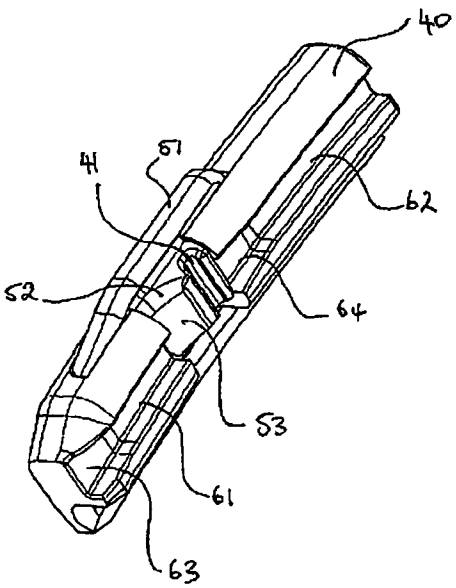
Figure 4:
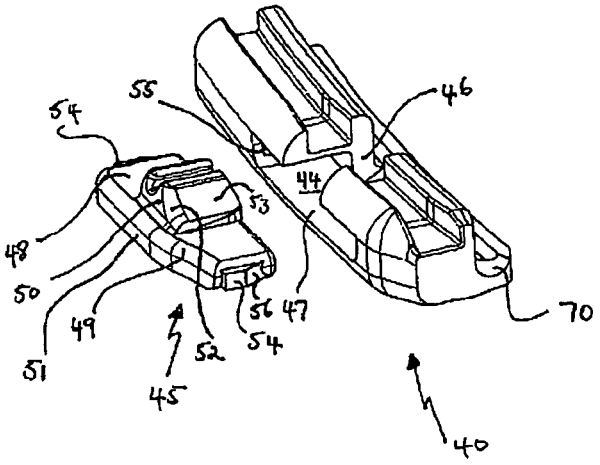
FIG. 4 is an exploded view of the lock of FIG. 1.
Figure 5:
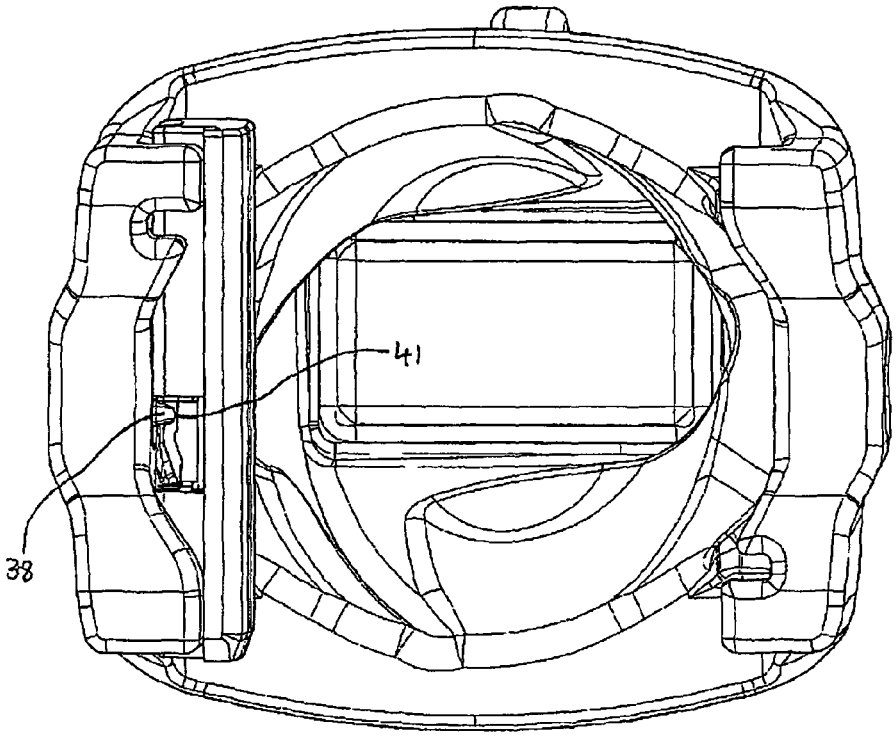
FIG. 5 is a rear end view of the point of FIG. 1 with the lock in the position where it would lock the point to the adapter and showing the detent received in the recess.
Figure 6:
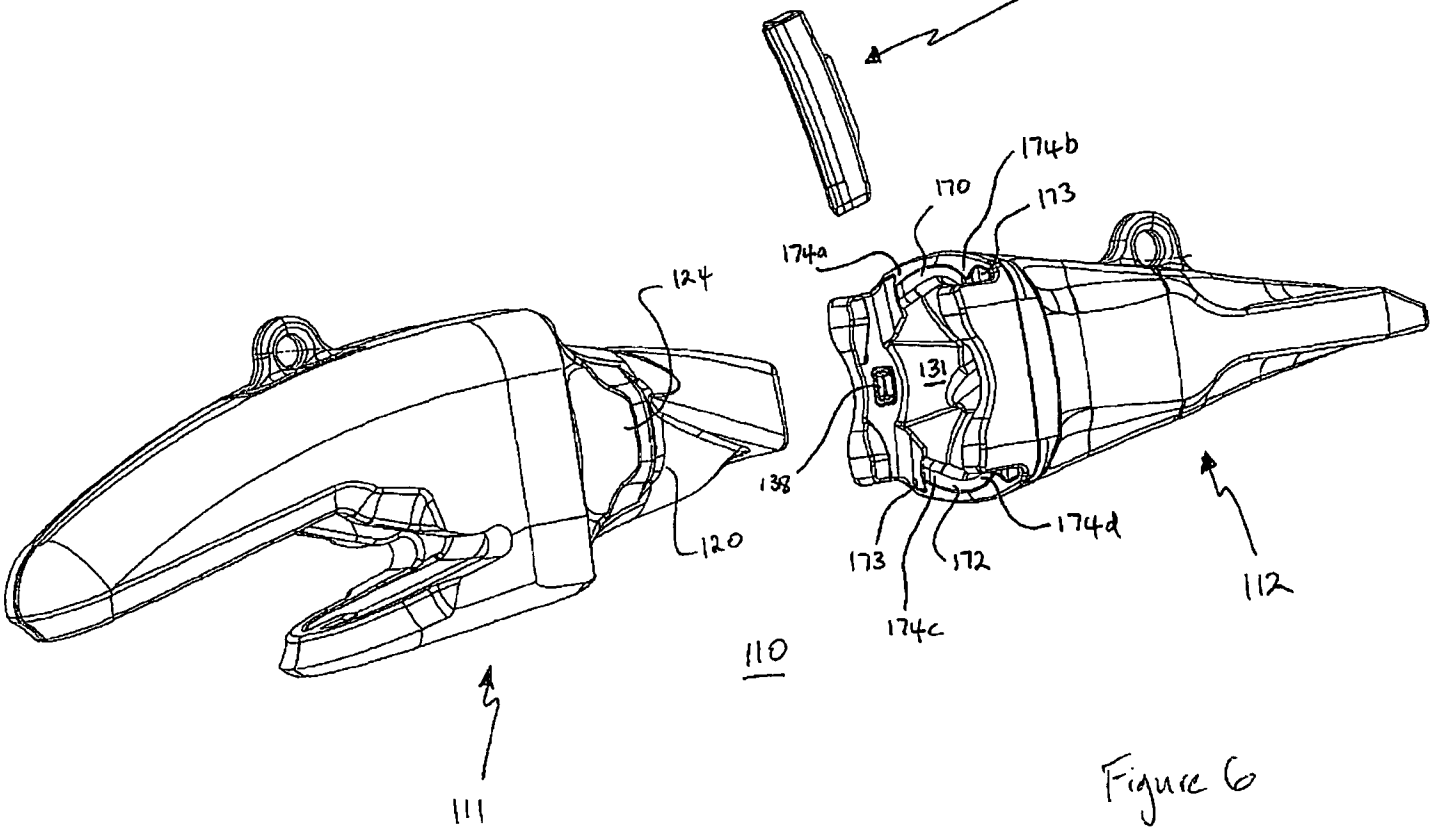
FIGS. 6 and 7 are exploded perspective views of an excavation tooth assembly according to another embodiment.
Figure 7:
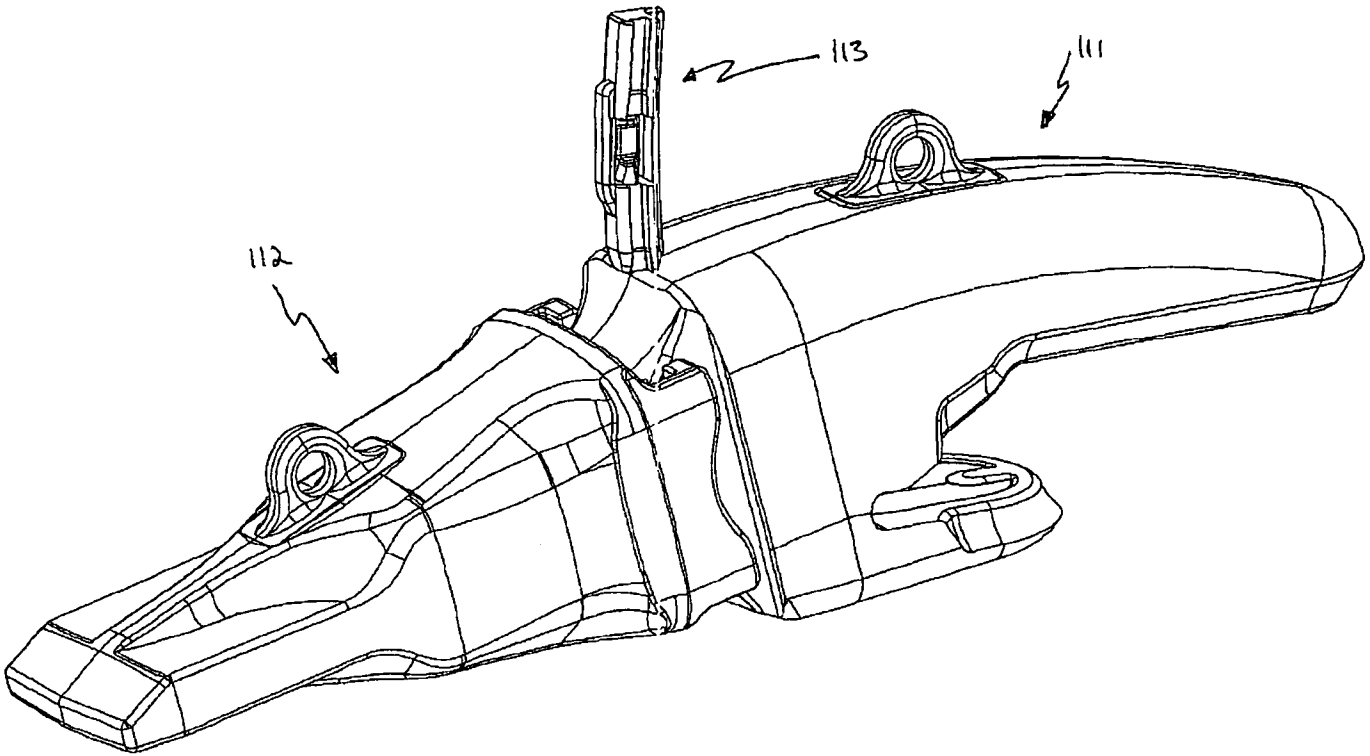
Figure 8:
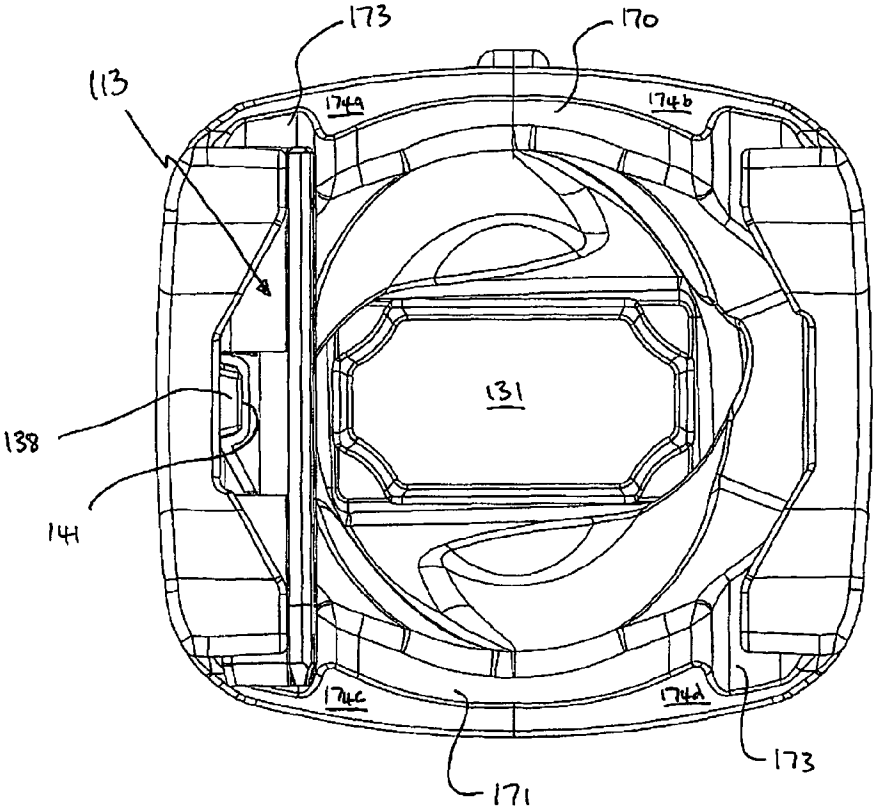
FIGS. 8 and 9 are rear and top views respectively of the assembled excavation tooth assembly of FIG. 6.
Figure 9:
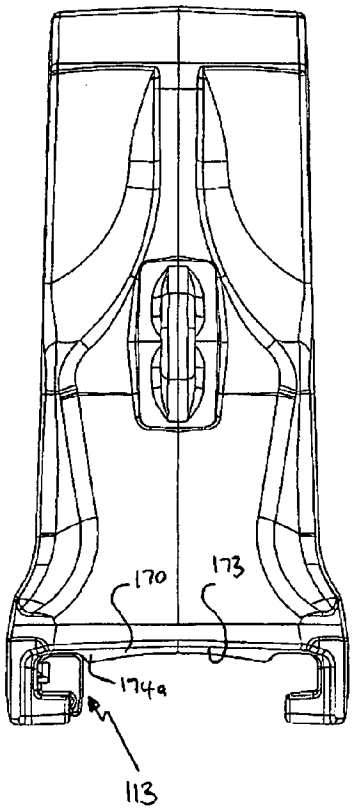
Figure 11:
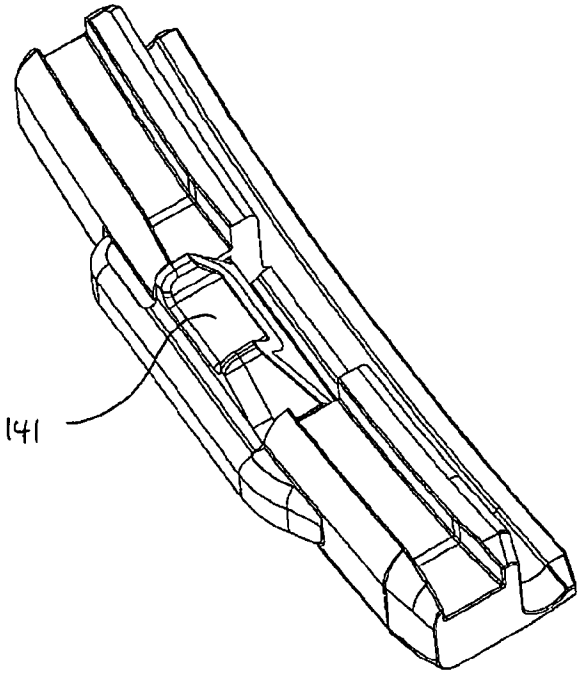
FIGS. 10, 11 and 12 are side, perspective and exploded views of a lock of the excavation tooth assembly of FIG. 6.
Figure 10:
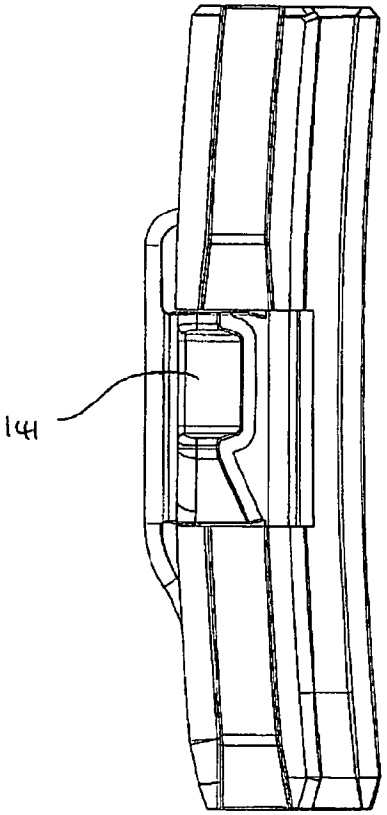
Figure 12:
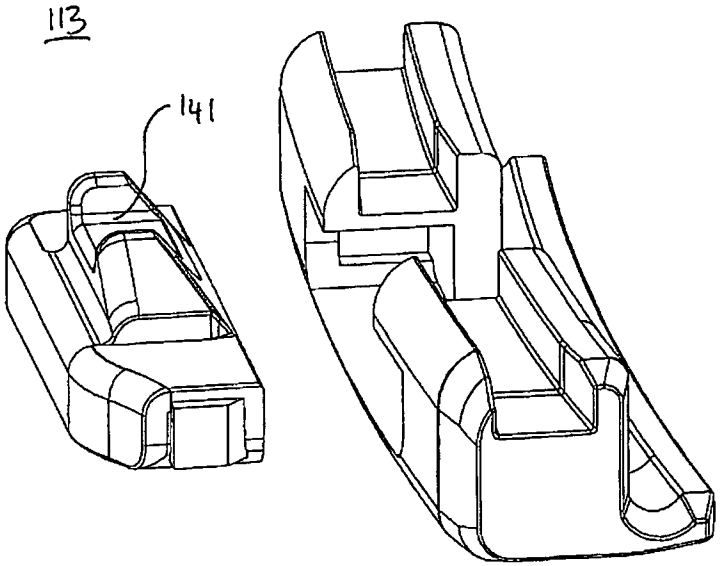
Figure 13:
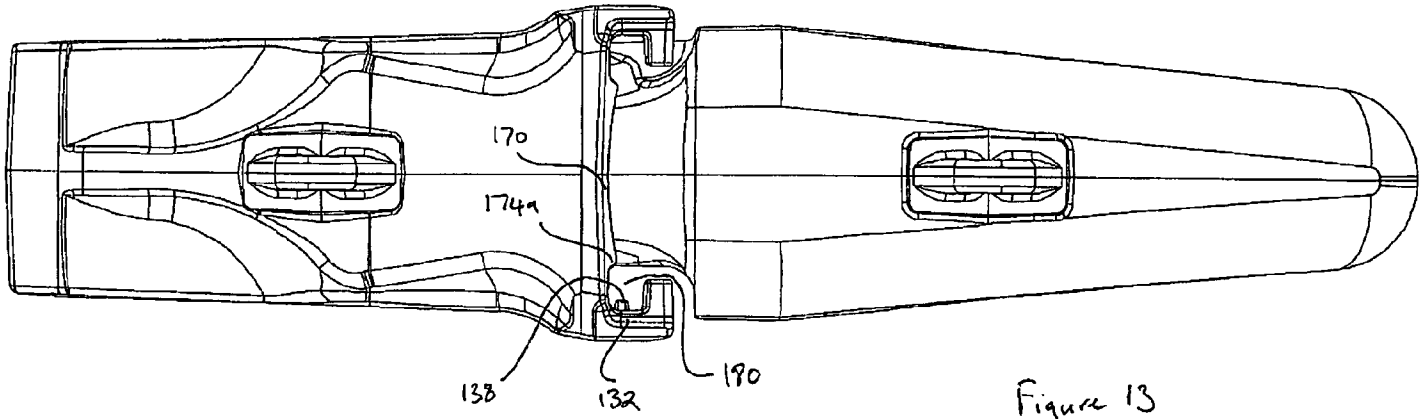
FIGS. 13 and 14 are a plan view and a cross-sectional plan view respectively of the point and adapter of the excavation tooth assembly of FIG. 6.
Figure 14:
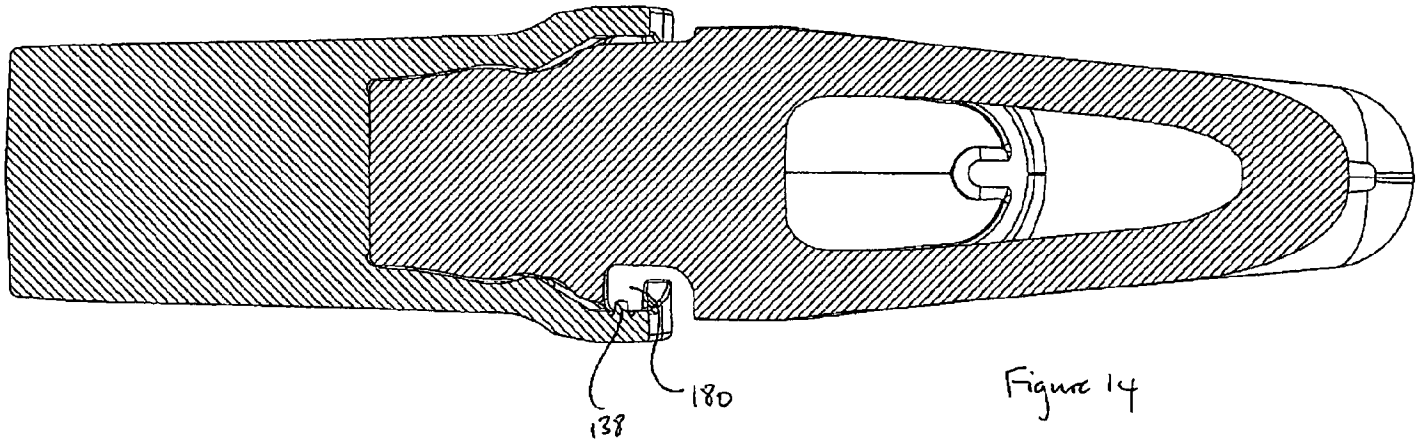
Figure 15:
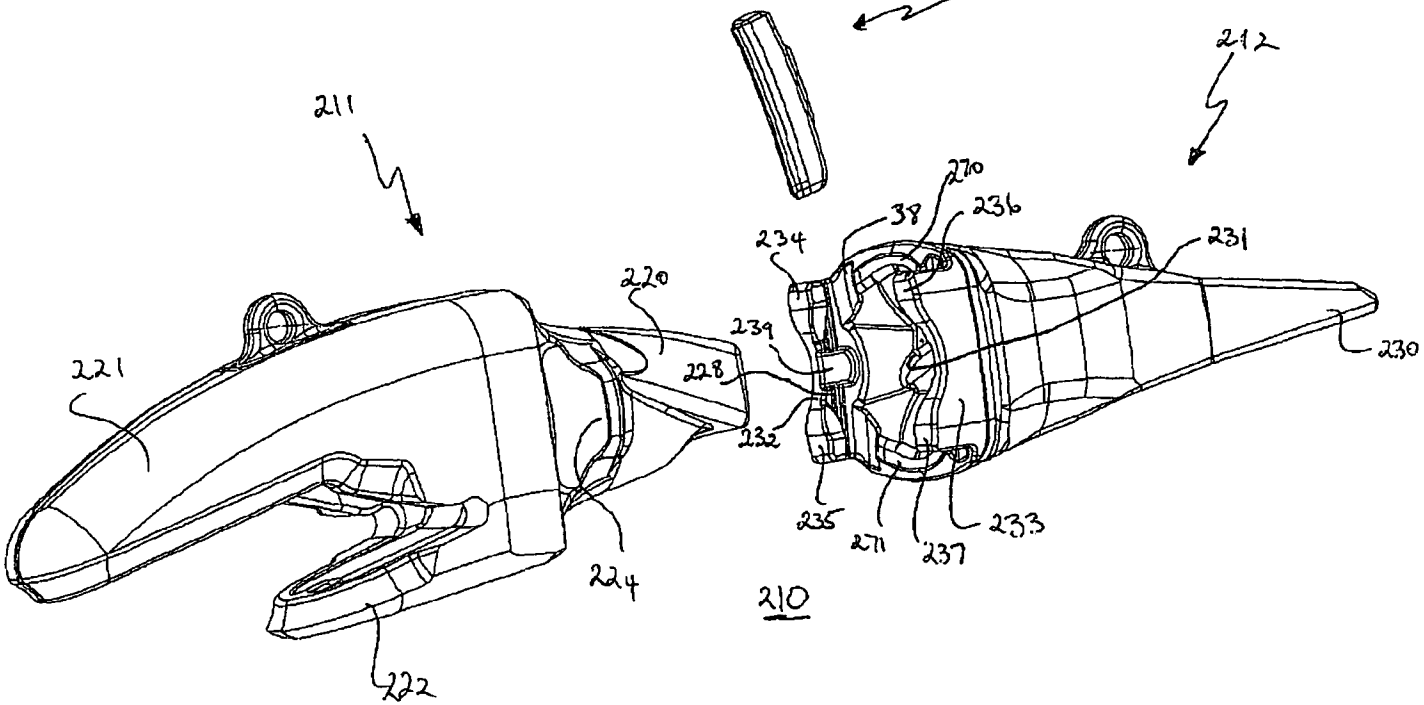
FIG. 15 is an exploded perspective view of an excavation tooth assembly according to another embodiment comprising an excavation tooth point, an excavation tooth adapter and a lock.

Referring in particular to FIGS. 3 and 4, the lock 13 comprises a body 40 in the form of a unitary metal (eg. steel) casing. The lock 13 also comprises a recess 41 for receiving the detent 38 of the point 12 to releaseably retain the lock within the locking space 80. The recess 41 shown in FIGS. 1-5 is in the form of an elongate slot. However, other suitable types of recesses may be employed such as circular or rectangular indentations or through holes. The lock 13 is inserted between the point 12 and the adapter 11 after they have been coupled together by hammering the lock 13 (or otherwise applying a sufficient force to the lock) into one of the locking spaces 80 until the detent on the relevant point ear 32, 33 is received in the lock recess 41. To remove the lock 13, a further force is applied in the same direction as was applied during insertion which is sufficient for the detent to clear the recess.

Although the embodiment shown and described in FIGS. 1-5 has the detent formed on a surface of the point, the detent may instead be formed on a surface of the adapter.

The body 40 of the lock 13 is elongate and slightly curved in its longitudinal direction such that it is slightly convex at its front 42 and slightly concave at its rear 43. Nominal descriptions of 'front' and 'rear' have been provided of the lock body 40 which conform with the orientation of the lock 13 with respect to the point 12 when it is inserted into the locking space between the point and the adapter 11 (see FIGS. 1 and 2).

The body 40 has a compartment 44 for receiving a resilient insert 45 located in an intermediate portion of the body 40. For the lock 13 to be used, it is noted that the body 40 and insert 45 must be assembled with the insert received in the compartment 45. The compartment 44 has openings 46, 47 for portions of the insert 45 to protrude from when the insert 45 is received in the compartment 44. One of the openings 46 is located in the side of the body 40 and the other opening 47 is located at the front 42 of the body 40.

The insert 44 comprises a unitary elastomeric block 48 and two bearing members 49, 50. The elastomeric block 48 allows the lock 13 to be deformed in order to insert (and remove) the lock 13 between the point 12 and the adapter 11. In particular, the elastomeric block allows the bearing member 49, 50 to be pressed in as the lock is inserted (and removed). The elastomeric block 48 also biases the lock 13, specifically the bearing members 49, 50, towards its at rest shape.

Although the lock shown in FIGS. 1-5 has a single insert comprising a unitary elastomeric block it is to be understood that the insert may comprise multiple elastomeric blocks or that the lock may comprise more than one insert each comprising one or more elastomeric blocks. For example, the first bearing member may be mounted to a first elastomeric block and the second bearing member may be mounted to a second elastomeric block.

However, advantageously, the embodiment shown in the Figures having a unitary elastomeric block in a single compartment of the lock body is easier and more cost effective to manufacture. In particular, this is because the casting of the lock body with the single elastomeric block is easier to cast.

The bearing members 49, 50 are typically formed of metal such as steel. The bearing members may be formed as separate members and individually bonded to the elastomeric block 48 or they may be formed as a unitary element (which is bonded to the elastomeric block). The first bearing member 49 is located on a front face of the elastomeric block 48 and protrudes from the front opening 47 of the compartment 44. The first bearing member 49 provides an adapter bearing face 51 for bearing against the adapter 11 when the lock is in its operative position and locking the point to the adapter. More specifically, the adapter bearing face 51 is for bearing against one of the adapter ledges 24. The adapter bearing face 51 also aids in the locking of the point 12 to the adapter 11 by acting against vertical forces of rotation on the point 12.

The rear 43 of the lock body bears against one of the pairs of lugs (34 and 35 for example) when the lock is in its operative position and locking the point to the adapter. This bearing of the lock body rear 43 provides a opposing force to the adapter bearing face 51. Notably, because the adapter bearing face 51 is mounted to the elastomeric block 48, the lock self tightens as it or the adapter wears. This is because the elastomeric block pushes the adapter bearing face 51 outwards from the lock.

The second bearing member 50 is located on a side face of the elastomeric block 48 and protrudes from the side opening 46 of the compartment 44. The second bearing member 50 has the recess 41 of the lock 13 formed therein. Because of the position of the compartment 44 in the body 40, the recess 41 is located at an intermediate portion of the lock 13. The recess 41 is in the form of an elongate slot, which is elongate in a direction which is transverse to the longitudinal extent of the lock body 40. The dimensions of the recess 41 ensure that the detent 38 of the point resides firmly in the recess 41 once received therein (ie. the detent 38 is not free to move around in the recess 41) to avoid the lock slipping after it has been inserted into its locking position.

The lock 13 also comprises a shoulder element 52 which is formed on the second bearing member 50 for aiding the lock in passing over the detent as the lock is inserted into the locking space before the detent is captured in the recess. The shoulder element 52 provides a sloping bearing face 53 or ramp which rises towards the detent entry side of the recess. When the lock is inserted between the point and the adapter, the sloping bearing face 53 engages and travels over the detent 38 with increasing force on the shoulder element 52 towards the lock 13. Compression of the underlying elastomeric block 48 occurs under this force allowing the shoulder element 52 to gradually clear the detent 38. Once the lock has been sufficiently inserted to align the recess 41 with the detent 38, the bias of the elastomeric block 48 pushes the recess 41 towards the detent 38 so that the detent is received therein.

The insert 45 also comprises tabs 54 at its top and bottom for keying into depressions 55 at the top and bottom of the compartment 44 to lock the insert 45 into the compartment (see FIG. 4). The insert 45 is received in the compartment 44 through the front opening 47. During this process, the tabs 54 deflect into the insert 45 as angled engaging surfaces 56 of the tabs 54 initially engage the top and bottom of the compartment respectively. This enables the insert 44 to clear the opening 47. However, the tabs 54 are biased towards their at rest position and thus once they align with the depressions 55 move outwardly to be received therein to lock the insert in the compartment. It is to be understood that the insert 45 may comprise mechanisms other than the tabs for securing the insert 45 in the compartment 44. For example, the tabs could be formed on the lock body and the depressions formed in the insert or a chemical bond may be formed between the insert and the body 40. In another arrangement, the insert may have a ledge which abuts a lip of the compartment once the insert has been positioned in the compartment. In this arrangement, the abutment of the ledge on the lip prevents the insert from inadvertently coming out of the compartment.

The lock 13 also comprises a groove 60 for enabling the lock to clear the detent 38 when inserting the lock into and removing the lock from the locking space between the adapter and the point. Accordingly, the width and depth of the groove along its length is approximately equal to or slightly greater than the width and height of the detent 38. The groove 60 is formed in a side of and extends the length of the lock body 40. The groove 60 is slightly curved with the curvature of the lock body 40. The groove 60 comprises first and second groove portions 61, 62 either side of the recess 41 (and either side of the side opening 46 of the compartment 44). The first groove portion 61 widens at its distal end 63 from the recess 41. The distal end of the first groove portion is at the leading edge of the lock 13 as it is inserted. The wider distal end 63 thus helps locate the detent 38 into the groove 60 as the lock is inserted. The second groove portion 62 widens at its proximal end 64 to the recess 41. The wider proximal end 64 similarly helps locate the detent 38 into the groove 60 when the lock is being removed and the recess is pushed over the detent 38.

The lock 13 also comprises a ridge 70 extending from the rear 43 of the lock body 40 for engaging the ears 34-37 on one of the point walls 32, 33. The ridge 70 acts as a key to prevent the lock 13 being inserted into the space between the point 12 and the adapter 11 in the wrong orientation in which it could possibly get jammed.

Referring now to FIGS. 6-14, an excavation tooth assembly 110 according to another embodiment of the present invention is shown. The assembly 110 has similar features to the excavation tooth assembly 10 shown in FIGS. 1-5. Such features have been given the same reference number but have been prefixed with the numeral 1.

The assembly 110 comprises an adapter 111, a point 112 and a lock 113. The adapter 111 has a nose portion 120 and the point 112 comprises a body having a first digging end and an opposite second end which incorporates a socket 131 in which the nose portion of the adapter is received. The lock 113 locks the point to the adapter.

The excavation tooth assembly 110 also comprises upper and lower ridges, 170 and 171 respectively, which project from the rear surface 173 of the point 112. The rear surface 173 of the point 112 is provided at the second end of the point body. The ridges 170, 171 are formed above and below the socket 131 (which opens in the rear surface 173). The ridges 170, 171 extend between but are spaced from the rearwardly extending ears 132, 133. The ridges 170, 171 extend laterally across the rear surface 173 of the point and are concave in shape with thicker end portions 174*a-d* that project further from the rear surface of the point 112 than the central portion of each ridge. The side surfaces of the end portions 174*a-d* form opposing surfaces with their respective opposing ears 132, 133. The end portions 174*a, b* of the upper ridge 170 form upper opposing surface portions and the end portions 174*c, d* of the lower ridge form lower opposing surface portions. These opposing surfaces together with the rear surface 173 also form part of the locking spaces 180 into which the lock 113 can be inserted to lock the point 112 to the adapter 111. The opposing surfaces extend from a rear portion of the point (at the second end of the point body) towards the front of the point, which is at the first digging end of the point body.

The provision of the ridges 170, 171 constrains the top and bottom of the lock 113 against lateral movement with respect to the point 112 once inserted into its operative position in the locking. This ensures that the recess 141 of the lock 113 remains engaged with the detent 138 on the point when the parts of the assembly 10 become worn through use.

In a variation not shown in the Figures, the upper and lower ridges may be replaced with protrusions which extend from the rear surface 173 at a location near to but spaced from the rearwardly extending ears 132, 133. Such protrusions form opposing surfaces with respective ears and provide the function of the end portions 174*a-d* of the ridges to constrain the top and bottom of the lock against lateral movement with respect to the point.

In a further variation, at least one indentation is provided at the second end of the point body which defines the opposing surfaces. In this embodiment, each indentation extends from a rear portion of the point towards the front of the point.

Figure 16:
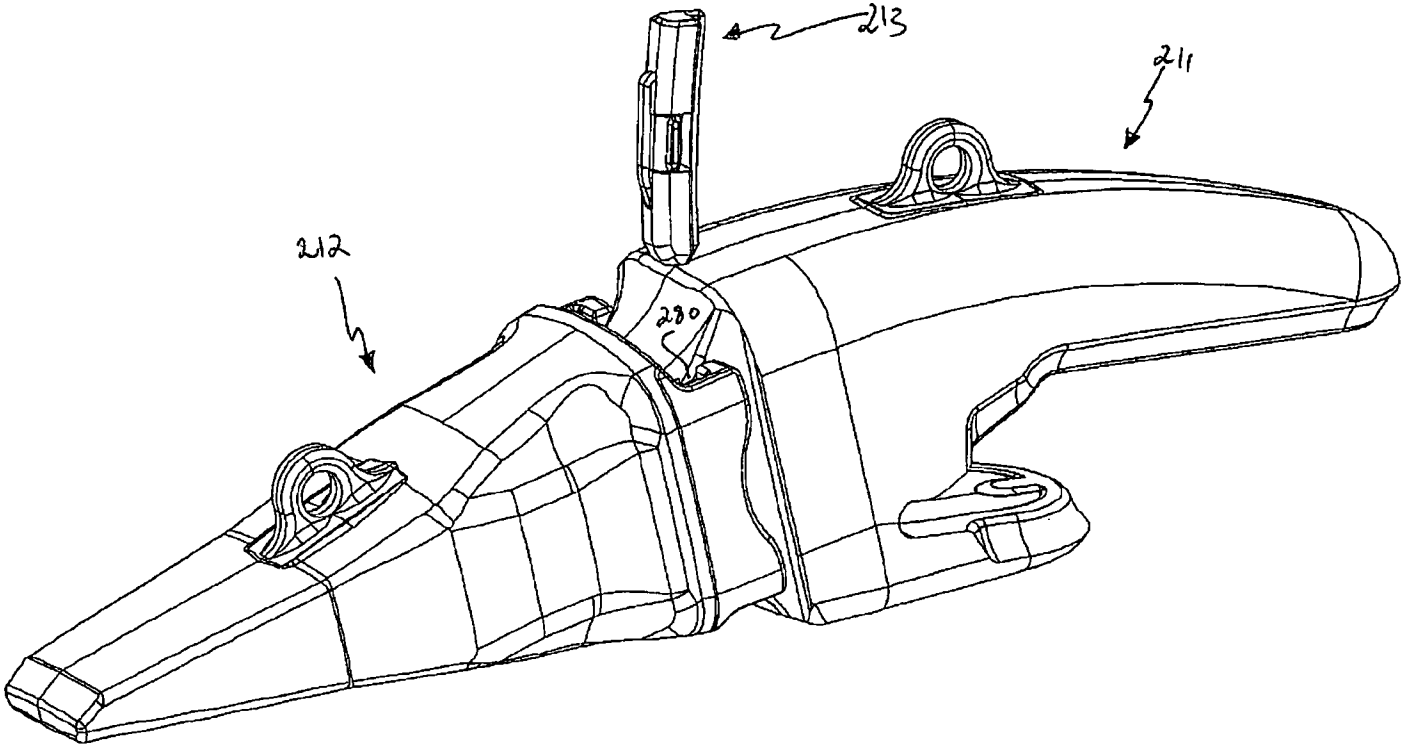
FIG. 16 is a perspective view of the excavation tooth assembly of FIG. 15 showing the lock being inserted into a locking space between the point and the adapter to lock the point to the adapter.
Figure 17:
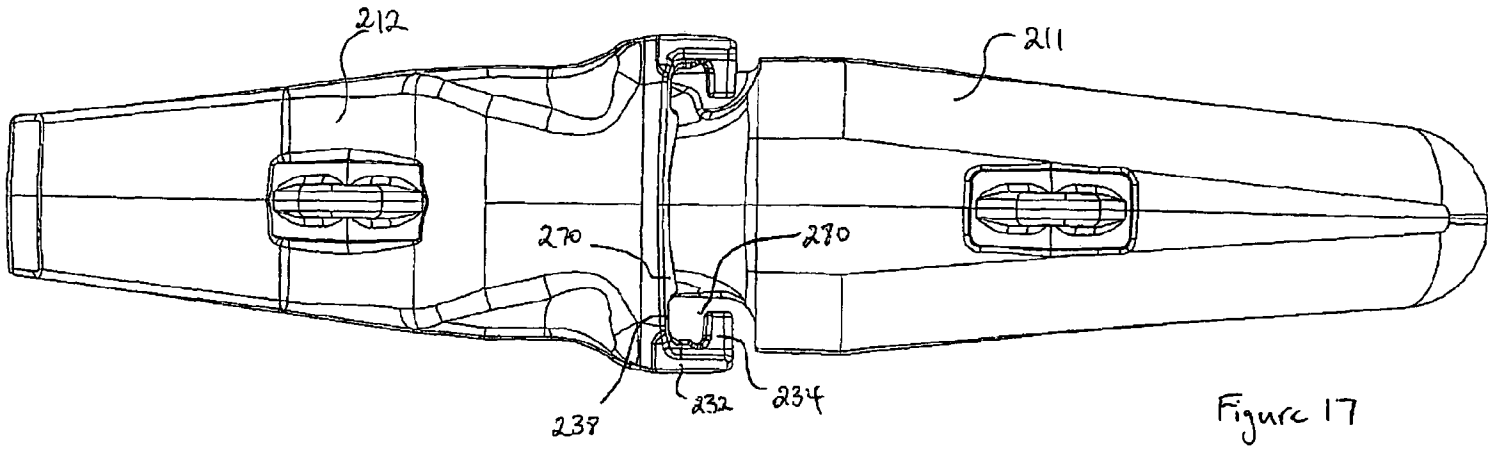
FIG. 17 is a plan view of the point and the adapter of the excavation tooth assembly of FIG. 15 in an assembled condition.
Figure 18:
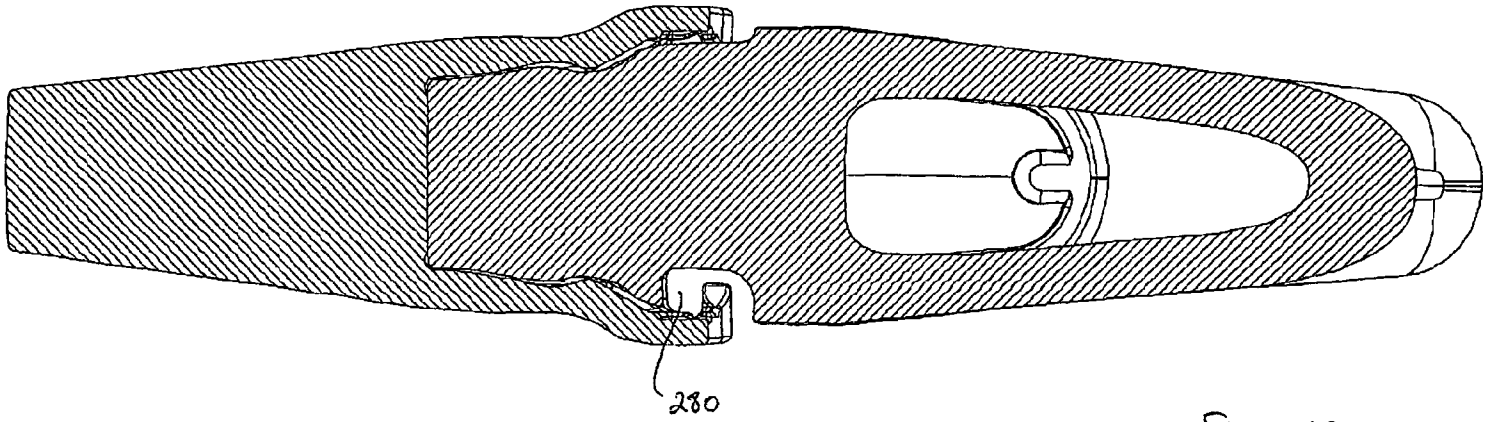
FIG. 18 is a cross-sectional plan view of FIG. 17.
Figure 19:
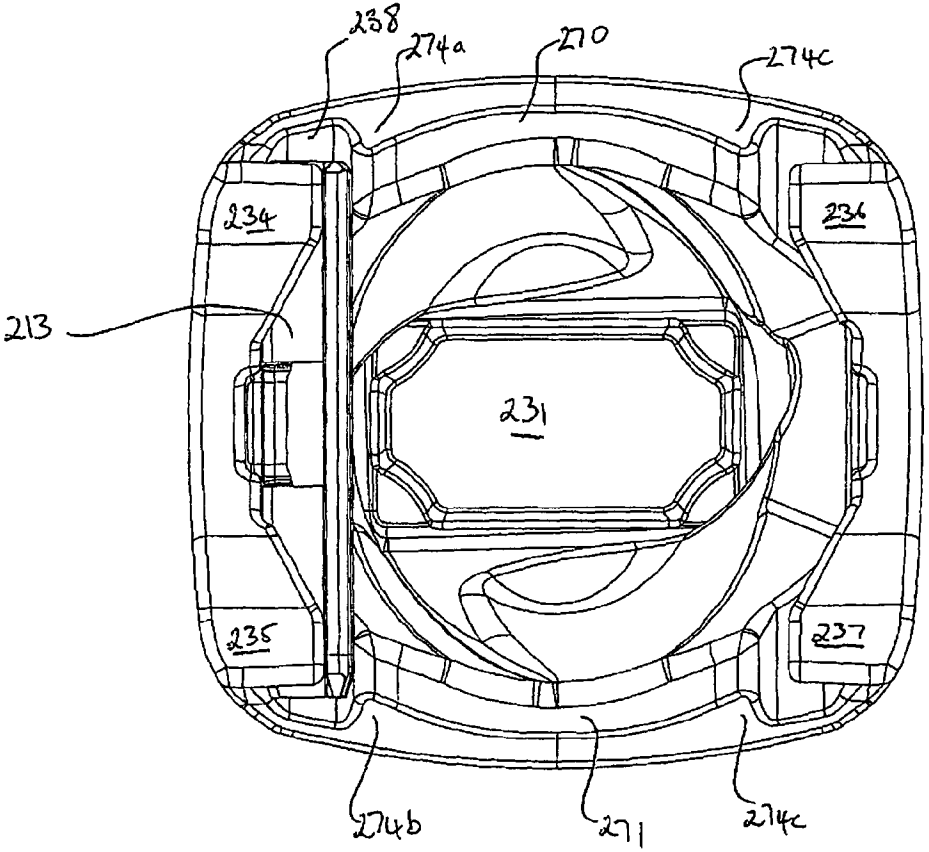
FIG. 19 is a rear end view of the point of FIG. 15 with the lock in a position where it would lock the point to the adapter.
Figure 20:
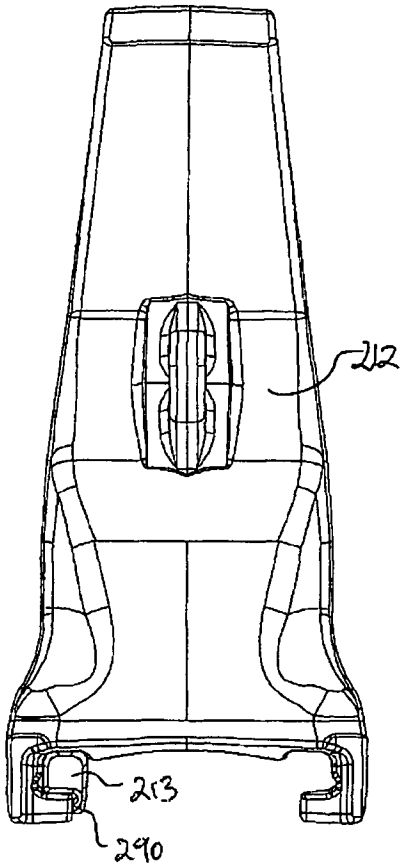
FIG. 20 is a plan view of FIG. 19.
Figure 21:
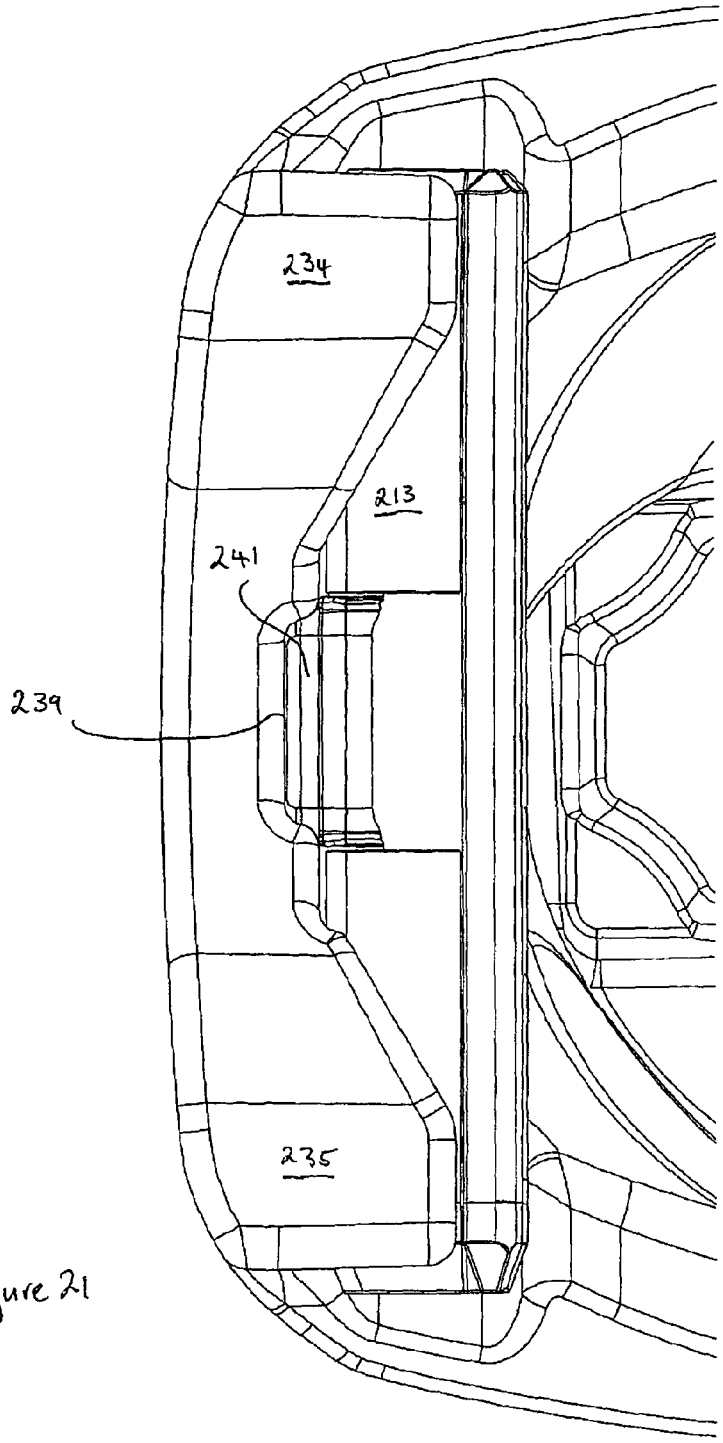
FIG. 21 is a close-up view of FIG. 19.
Figure 22:
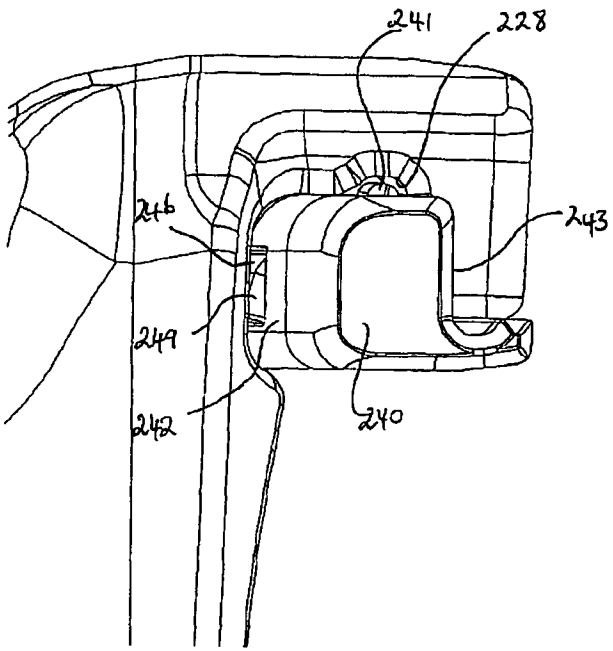
FIG. 22 is a close-up underneath view of the lock and point of FIG. 19.
Figure 23:
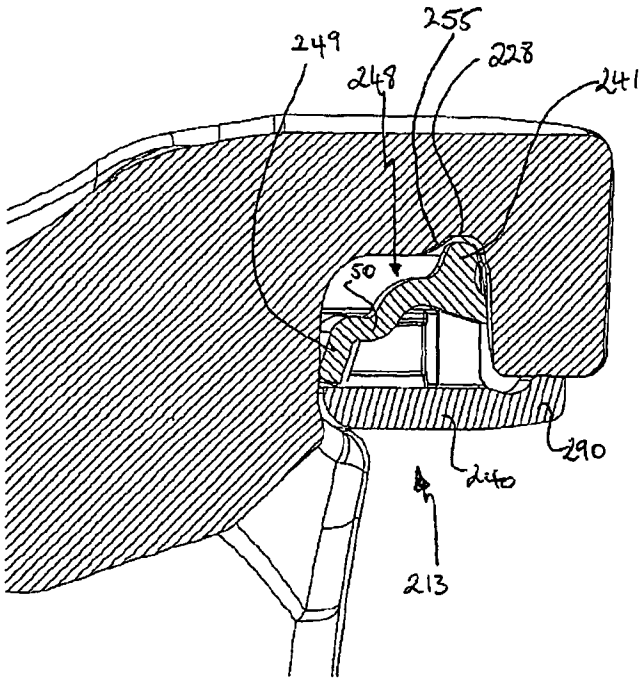
FIG. 23 is a cross-sectional view of FIG. 22.
Figure 24:
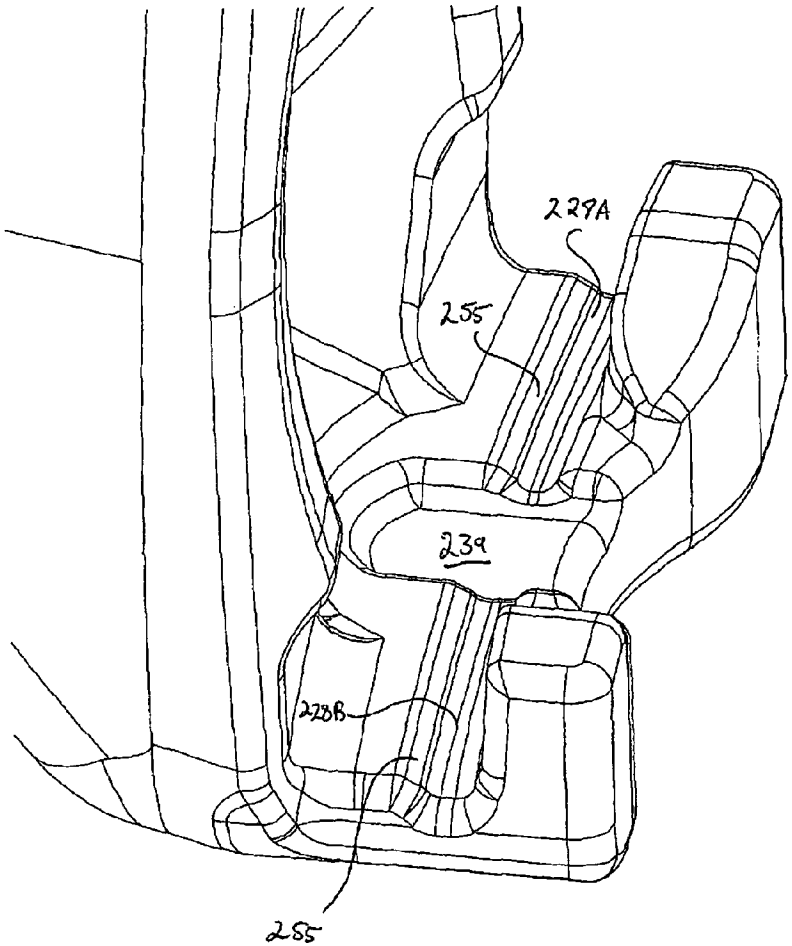
FIG. 24 is perspective view of a rear part of the point of FIG. 15, in particular showing an ear of the point which forms part of the locking space.
Figure 25:
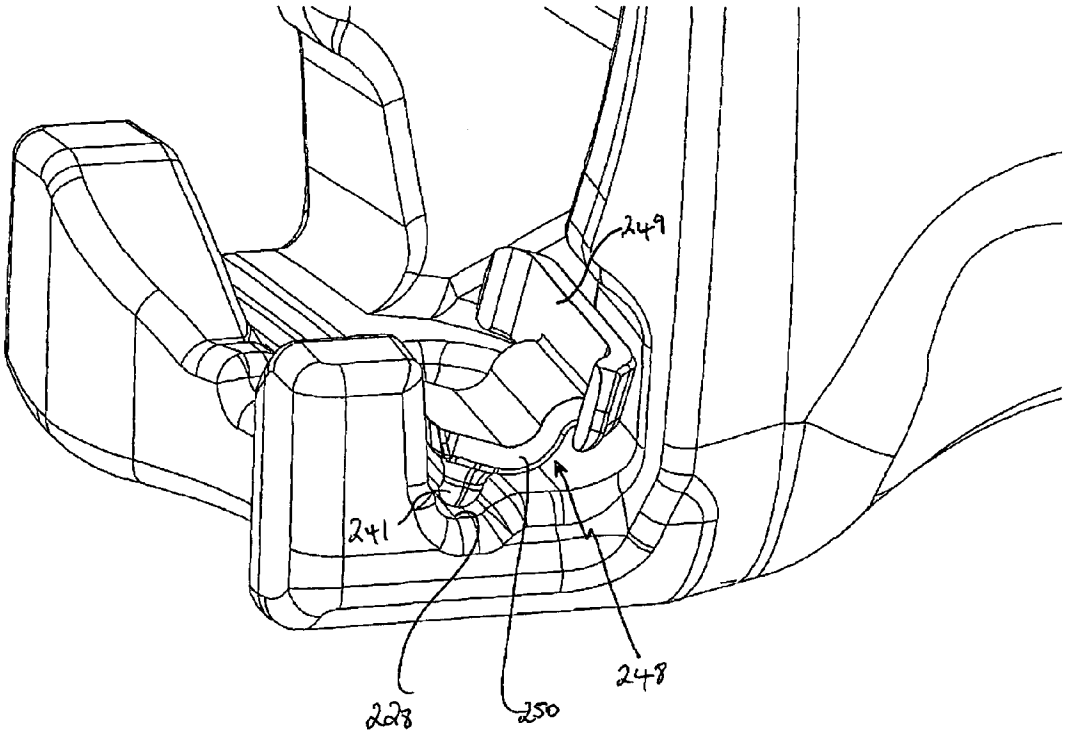
FIG. 25 is perspective view of the ear of the point of FIG. 15 showing the position of an engaging element of the lock (in isolation) with respect to the point as the lock is initially inserted into the locking space.
Figure 27:
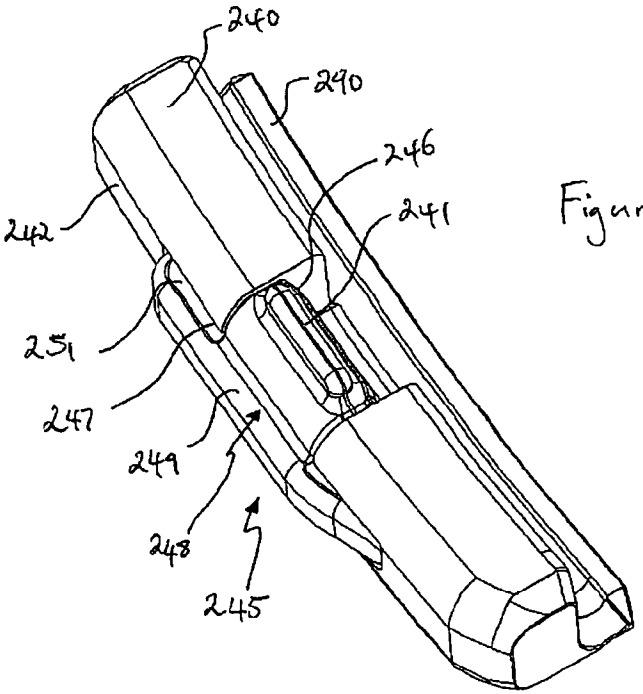
FIGS. 26 and 27 are side and perspective views of the lock of FIG. 15.
Figure 26:
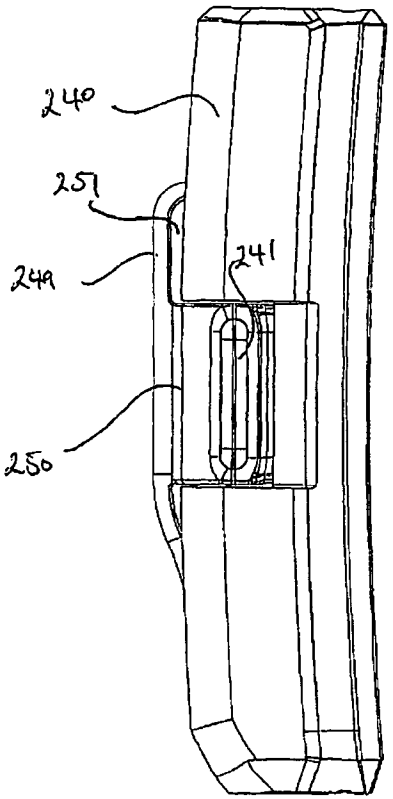
Figure 28:
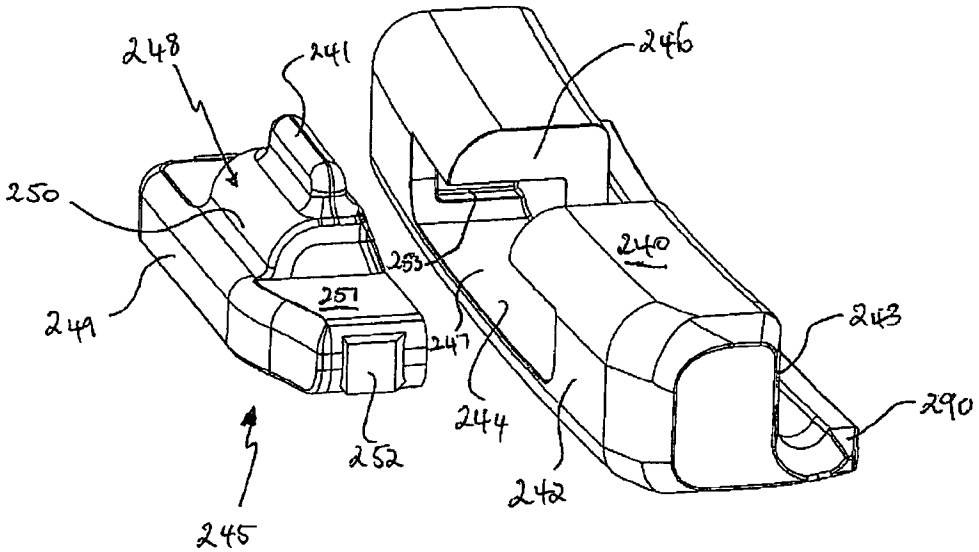
FIG. 28 is an exploded perspective view of the lock of FIG. 15.
Figure 30:
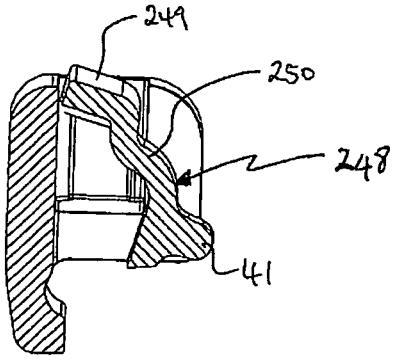
FIG. 30 is a cross-sectional view of FIG. 29.
Figure 29:
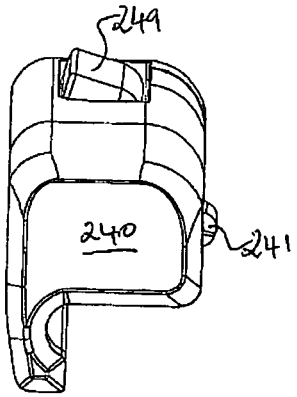
FIG. 29 is a top perspective view of the lock of FIG. 15 with an engaging element of the lock in a retracted condition.

Referring now to FIGS. 15-30, an excavation tooth assembly 210 according to another embodiment is shown. The assembly 210 has similar features to the excavation tooth assemblies 10, 110 shown in FIGS. 1-14. The assembly 210 comprises an excavation tooth adapter 211 for mounting the excavation tooth to the digging edge of digging equipment, an excavation tooth point 212 which couples to the adapter 211 in an assembled condition (FIG. 16) and a lock 213 for locking the point 212 to the adapter 211 when in their assembled condition to form the excavation tooth.

The adapter 211 is a conventional excavation tooth adapter and comprises a forward projecting nose 220 and rearward arms 221, 222. The rearward arms 221, 222 are positioned at either side of the digging edge of digging equipment in order to mount the adapter 211 thereto. The forward projecting nose 220 has a conventional "twisted" shape to reduce the torsion stresses on the adapter in use. Ledges 224 project from either side of the nose 220, the purpose of which will be described below.

The point 212 comprises a digging edge 230 at a first end and a socket 231 at an opposite second end for receiving the nose 220 of the adapter 211 the point extends along a longitudinal axis between its first and second ends. The socket 31 opens in a rear surface 238 of the point and has an internal "twisted" shape, which conforms with the shape of the adapter nose 220. The point 212 is thus assembled with the adapter 211 by positioning the socket 231 at the end of the nose 220 and then twisting and pushing the point 212 until the nose 220 is received in the socket.

Ears 232, 233 on either side of the point 212 extend rearwardly of the rear surface 238 away from the socket 231. Each ear 232, 233 has upper and lower lugs 234-237 extending inwardly towards the opposite ear at right angles to their respective ears. The lugs 234-237 are located at the distal end of their respective ears 232, 233. When the point 212 is assembled with the adapter 211 with the adapter nose 220 fully received in the point socket 231, one of the ears, its respective lugs and a portion of the rear surface 238 of the point 212 together with one of the ledges 224 of the adapter 211 create a locking space 280 on one side of the excavation tooth into which the lock 213 can be inserted to lock the point and the adapter in their assembled condition. The other of its ears, its lugs, another portion of the point's rear surface 238 and the other ledge is also capable of creating a locking space on the other side of the tooth. It is noted, however, that as the tooth in many applications requires only one lock (and hence one locking space) that in some embodiments the point may differ from the embodiment shown in FIGS. 15-30 in having only one ear.

The point 212 also comprises an engaging portion in the form of a recess 239 for interengaging with an engaging portion of the lock 213 to lock the point and the adapter in their assembled condition. The recess 239 is located on one of the ears 232 at an intermediate portion of the ear located vertically between the lugs 234, 235. The recess 239 extends in the longitudinal direction of the point 212 (ie. parallel to the longitudinal axis of the point), from a rear edge of the ear 232 towards the digging edge of the point and slightly into the opening of the socket 231. A further recess which is identical to the recess 239 shown, is located at an identical position on the other ear of 233. This enables the point 212 to be assembled with and locked to the adapter in an upside down orientation to that shown in the Figures. This is particularly useful in extending the life of the point 212 if the digging edge 230, in use, is wearing more on the top or bottom.

The point 212 also comprises a groove 228 extending transversely with respect to the longitudinal axis of the point 212 and is slightly curved. The groove 228 is formed in the ear 232 and comprises upper and lower groove portions 228A, 228B above and below the recess 239 respectively. Upper groove portion 228A extends from the top of the ear 232 to the recess 239 and similarly the lower groove portion 2288 extends from the bottom of the ear to the recess. The purpose of this groove 228 will be described in further detail with respect to the lock below. It is noted that as with the recess, a further identical groove is provided on the other ear 233 so that the point 212 can be used in an upside down orientation to that shown in FIGS. 15-30. In another variation (not shown), the recess 239 and the groove 228 are formed on a surface of the adapter which forms part of the locking space.

The point also comprises upper and lower ridges 270 and 271 respectively, which are project from the rear surface 238 of the point 212. The ridges 270, 271 are similar to the ridges 170-171 shown and described in relation to FIGS. 6-14. The ridges 270,271 are formed above and below the socket 231 and are spaced from the rearwardly extending ears 232, 233. The ridges 270, 271 extend laterally across the rear surface 238 of the point and are concave in shape with thicker end portions 274*a-d* that project further from the rear surface of the point 212 than the central portion of each ridge. The side surfaces of the end portions 274*a-d* form opposing surfaces with their respective opposing ears 232, 233. These opposing surfaces also form a part of the locking spaces 280. The opposing surfaces extend from the second end of the point body towards the first digging end of the point body, parallel to the longitudinal axis of the point.

Referring in particular to FIGS. 26-30, the lock 213 comprises a body 240 in the form of a unitary metal (eg. steel) casing. The lock 213 also comprises an engaging portion in the form of a projection 241 mounted to the lock body and which is configured to be received in the recess 239 of the point 212 to releaseably retain the lock within the locking space 280. The recess 239 and the projection 241 form a lock assembly which when coupled act to releasably retain the lock within the locking space 280. The lock 213 is inserted between the point 212 and the adapter 211 after they have been coupled together by hammering the lock 213 (or otherwise applying a sufficient force to the lock) into one of the locking spaces 280 until the projection 241 of the lock is received in the recess 239 of the point. To remove the lock 213, a further force is applied in the same or opposite direction as was applied during insertion which is at least initially sufficient for the projection to clear the recess and then to drive the lock 213 out of the locking space 280.

Although the embodiment shown in FIGS. 15-30 and described below involves a projection of the lock interengaging with a recess of the point to hold the lock in the locking space, in some embodiments of the invention the lock may have a recess and the point may have a projection which interengage to hold the lock in the locking space.

The body 240 of the lock 213 is elongate along a longitudinal axis and slightly curved in its longitudinal direction such that it is slightly convex at its front surface 242 and slightly concave at its rear surface 243. Nominal descriptions of 'front' and 'rear' have been provided of the lock body 240 which conform with the orientation of the lock 213 with respect to the point 212 when it is inserted into the locking space 280 between the point and the adapter 211 (see FIGS. 15 and 16).

The body 240 has a cavity 244 for receiving an insert 245 located in an intermediate portion of the body 240. For the lock 213 to be used, it is noted that the body 240 and insert 245 must be assembled with the insert received in the cavity 245. The cavity 244 has openings 246, 247 for portions of the insert 245 to protrude from when the insert 245 is received in the cavity 244. One of the openings 246 is through a side surface of the body 240 and the other opening 247 is through the front surface 242 of the body 240.

The insert 245 comprises an engaging element 248 for engaging a surface of the adapter to lock the point and the adapter in their assembled configuration as well as to hold the lock in the locking space 280. The engaging element 248 is a unitary member formed from a metal such as steel. The engaging element 248 incorporates the projection 241 which is configured to be received in the recess 239 of the point so as to hold the lock in the locking space 280. The engaging element 248 also incorporates a second engaging portion in the form of a second projection 249 for engaging a surface of the adapter, specifically one of the ledges 224. The second projection 249 is angularly spaced from the first mentioned projection 241 about the longitudinal axis of the lock body by approximately 90° (and remains so at all times during use). The second projection 249 projects through the opening 247 in the front of the 242 of the lock body 240. The first projection 41 projects through the opening 246 located in the side of the body 240. The engaging element 248 also comprises a web 250 connecting the second projection 249 and the first projection 241. The web 250 has a 90° bend in it in order to extend between the first projection and the second projection. Although there may be a small amount of flex in the web 250, it generally holds the first projection 241 and the second projection 249 in their orientation with respect to each other at all times during use of the lock.

Both the first projection 241 and the second projection 249 have a first at-rest and extend position (see FIGS. 26 and 27) in which they extend beyond respective outer surfaces of the lock body 240 and a second, retracted position (see FIGS. 29 and 30) in which they are retracted relative to the lock body, but still extend beyond respective outer surfaces of the lock body.

The insert 245 also comprises a resilient biasing element in the form of an elastomeric block 251 for biasing the first projection 241 and the second projection 249 towards their first at-rest positions. The elastomeric block 251 is held within the cavity 244, having upper and lower tabs 252 which are received in recesses 253 within the cavity to keep the elastomeric block 251 in the cavity 244. The engaging element 238 is bonded to the elastomeric block 251.

When the lock 213 is inserted into the locking space 280, the second projection 249 and the first projection 241 are caused to retract from their respective first positions towards their respective second positions. Because the first projection and the second projection are integrally formed as part of the engaging element 248, movement of one results in movement of the other (ie. their movement is interdependent). As the lock is inserted into the locking space, the second projection 249 initially engages a surface of the locking space causing it to be retracted into the lock body 240. This causes a corresponding retraction of the first projection 241.

As the lock is continued to be inserted into the locking space, the first projection 241 is captured in the groove 228. The groove 228 provides a guide for the first projection 241 as the lock is being inserted as well as preventing excessive retraction of the first projection 241 (and thus over-compression of the elastomeric block 251). The groove 228 causes further retraction of the first projection 241 into its second position (and thus also of the second projection 249 by its interdependent with the projection). In addition, a shoulder 255 of the groove also causes the first projection 241 to move laterally with respect to the lock body 240, which causes the second projection 249 to be further pulled in towards the lock body 240 (see FIGS. 23 and 25). This translation and retraction of the first projection 241 results in a rotation like movement of the engaging element 248 and of the first and second projections. Once the first projection 421 is aligned with the recess 239 in the point 212, the first projection 241 releases into the recess 239 under the resilient bias of the elastomeric block 251. This holds the lock 213 in its operative position within the locking space. The second projection 249 makes a corresponding movement towards its first position to engage one of the ledges 224 of the adapter 211. This locks the point and the adapter in their assembled condition. The resilient bias of the elastomeric block 251 means that as the parts of tooth wear in use, the second projection 249 moves towards its first position to "take-up" any gap due to wear. Because the recess 239 in the point extends parallel to the longitudinal axis of the point, the first projection 241 is free to adjust its position, in particular as the projection 249 moves due to "take-up" caused by wear.

The provision of the ridges 270, 271 on the point 212, in particular their end portions 274*a-d*, also constrains the top and bottom of the lock 213 against lateral movement with respect to the point 212 once inserted into the locking configuration. This ensures that the projection 241 remains engaged with the recess 239 on the point when the parts of the assembly 210 become worn through use.

The lock 213 also comprises a ridge 290 extending from the rear 243 of the lock body 20 for engaging the ears 234-237 on one of the point walls 232, 233. The ridge 290 acts as a key to prevent the lock 213 being inserted into the space between the point 212 and the adapter 211 in the wrong orientation in which it could possibly get jammed.

Advantageously, the excavation tooth assembly of the embodiments described above are easier to assemble and disassemble than prior tooth assemblies. In particular, the lock is easier to install and remove from the locking space. A significant reason for this is the provision of the groove in the point which allows one of the projections of the lock to run along as the lock is being inserted or removed from the locking space. The groove acts to guide the direction of the lock as it is being moved. This means that under the repeated percussive forces of hammering the lock into and out of the locking space, it is not driven in an incorrect angle and jammed. Furthermore, for the removal process, any fines which have collected in the groove during use are pushed out by the projection as it travels along the groove.

It is to be understood that, unless indicated otherwise by express language or necessary implication, the tooth members or locking members according to any embodiment of one aspect of the present invention may further encompasses any one or combination of features described above in relation to embodiments of other aspects of the present invention.

It is also to be understood that whilst the above description has been made in respect of a two part excavation tooth assembly (adaptor and point), the embodiments of the present invention described above may be incorporated into a three part excavation tooth assembly comprising an adaptor, a point and an intermediate member disposed between and coupling to each of the adaptor and the point. The intermediate member may have some of the features described above for the point and some of the features described above for the adaptor.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A lock for locking first and second tooth members of an excavation tooth assembly in an assembled condition, the lock comprising:

a body;

first and second engaging portions for engaging the first and second tooth members respectively mounted to the body and movable with respect to the body between respective first and second positions; wherein the engaging portions are interdependent so that movement of at least one of the first and second engaging portions causes a corresponding movement of the other of the first and second engaging portions, wherein at least one of the engaging portions retracts and moves laterally with respect to the lock body on movement from its first position to its second position.

2. The lock according to claim 1, wherein the lock body has a longitudinal axis and the engaging portions are angularly spaced apart about the axis.

3. The lock according to claim 1, wherein at least one of the engaging portions comprises a projection.

4. The lock according to claim 1, wherein at least one of the engaging portions comprises a recess.

5. The lock according to claim 1, wherein the first engaging portion is in an extended position in its first position and is in a retracted position relative to the lock body in its second position.

6. The lock according to claim 1, wherein the second engaging portion is in an extended position in its first position and is in a retracted position relative to the lock body in its second position.

7. The lock according to claim 5, wherein the first or second engaging portions when in its retracted position extends beyond an outer surface of the lock body.

8. The lock according to claim 1, wherein movement of at least one of the first and second engaging portions from the first position towards the second position causes a corresponding movement of the other of the first and second engaging portions from the first position towards the second position.

9. The lock according to claim 1, wherein the first and second engaging portions are interconnected so that the position of the first engaging portion relative to the second engaging portion is substantially fixed on movement of the engaging portions relative to the lock body.

10. The lock according to claim 9, wherein the first and second engaging portions are interconnected by a web.

11. The lock according to claim 1, wherein the first and second engaging portions are resiliently biased towards their respective first positions.

12. The lock according to claim 1 wherein at least one of the engaging portions rotates on movement from its first position to its second position.

13. The lock according to claim 1, wherein at least one of the engaging portions moves in two directions on movement from its first position to its second position.

14. A lock for locking first and second tooth members of an excavation tooth assembly in an assembled condition, the lock comprising:

a body;

first and second engaging portions for engaging the first and second tooth members respectively mounted to the body and movable with respect to the body between respective extended, at rest positions and respective retracted positions; wherein both the first and second engaging portions when in their extended at rest positions extend beyond an outer surface of the lock body, and both of the first and second engaging portions when in their retracted positions extend beyond an outer surface of the lock body.

15. The lock according to claim 14, wherein, the first engaging portion extends beyond a first outer surface of the lock body and the second engaging portion extends beyond a second outer surface of the lock body.

16. The lock according to claim 14, wherein the outer surface of the lock body is a surface which extends in the longitudinal direction of the lock body.

17. The lock according to claim 14, wherein the lock body has a cavity having a first opening through a first outer surface of the lock body, the first engaging portion retracting into the cavity as it moves towards its retracted position, but with at least a part of the first engaging portion projecting through the first cavity opening when in its second position and the cavity having a second opening through a second outer surface of the lock body, the second engaging portion retracting into the cavity as it moves towards its retracted position, but with at least part of the second engaging portion projecting through the second cavity opening when in its second position.

18. The lock according to claim 14, wherein the body has a front, a rear, and sides extending between the front and rear of the body and wherein the first engaging portion extends beyond one of the sides of the lock body and the second engaging portion extends beyond the front of the lock body.

19. A lock for locking first and second tooth members of an excavation tooth assembly in an assembled condition, the lock comprising:

a body that is elongate along a longitudinal axis;

first and second engaging portions for engaging the first and second tooth members respectively mounted to the body, each engaging portion movable with respect to the body between a first and a second position, wherein the at least one of the engaging portions is caused to rotate in moving from the first to the second position about the longitudinal axis of the lock body.

20. The lock according to claim 19, wherein the lock body is curved in its longitudinal direction.

21. An excavation tooth assembly comprising:

a first tooth member having a first end, an opposite second end incorporating a socket for receiving a nose portion of a second tooth member, and at least one surface which at least in part defines a locking space when the first tooth member is in an assembled condition with the second tooth member; and a lock according to claim 19, the lock configured to be inserted into the locking space to lock the first tooth member in its assembled condition with the second tooth member.

* * * * *